US006822404B2

(12) United States Patent
Matsumoto et al.

(10) Patent No.: US 6,822,404 B2
(45) Date of Patent: Nov. 23, 2004

(54) PHASE-CONTROLLED, MULTI-ELECTRODE TYPE OF AC DISCHARGE LIGHT SOURCE

(75) Inventors: Kazunori Matsumoto, Toyama (JP); Toru Nakajima, 23-24, Shimoshakujii 3-chome, Nerima-ku, Tokyo 177-0042 (JP); Shigeki Kawabata, Toyama (JP); Shigekazu Yamazaki, Toyama (JP); Seiji Oda, Toyama (JP); Tomohisa Yamamoto, Tokyo (JP)

(73) Assignees: Toyama Prefecture, Toyama (JP); Toru Nakajima, Tokyo (JP)

( * ) Notice: Subject to any disclaimer, the term of this patent is extended or adjusted under 35 U.S.C. 154(b) by 0 days.

(21) Appl. No.: 10/220,307

(22) PCT Filed: Mar. 13, 2001

(86) PCT No.: PCT/JP01/01951

§ 371 (c)(1),
(2), (4) Date: Dec. 30, 2002

(87) PCT Pub. No.: WO01/69649

PCT Pub. Date: Sep. 20, 2001

(65) Prior Publication Data

US 2003/0168988 A1 Sep. 11, 2003

(30) Foreign Application Priority Data

Mar. 13, 2000 (JP) ..... 2000-069525
Mar. 13, 2000 (JP) ..... 2000-069526
Mar. 13, 2000 (JP) ..... 2000-069527

(51) Int. Cl.[7] ..... H05B 37/00
(52) U.S. Cl. ..... 315/334; 315/343; 315/147
(58) Field of Search ..... 315/334, 343, 315/342, 341, 344, 147, 145, 197, 260, 267, 111.21, 39.51

(56) References Cited

U.S. PATENT DOCUMENTS 5,932,116 A * 8/1999 Matsumoto et al. ..... 315/147

FOREIGN PATENT DOCUMENTS

EP 0831679 A1 * 3/1998
JP 10125495 A * 5/1998
JP 10134994 A * 5/1998

* cited by examiner

*Primary Examiner*—Nilson Lee
*Assistant Examiner*—Ephrem Alemu
(74) *Attorney, Agent, or Firm*—Bacon & Thomas, PLLC

(57) ABSTRACT

An energy-saving, high-outputting and high-efficiency, electric discharge type of illumination apparatus and associated units having thin divisional electrode pieces arranged at relatively narrow intervals on an electrode-application area, which is defined on the bottom of a flat container. The divisional electrode pieces are fixed to the electrode-application area with an intervening sheet of good electrically insulating and thermally conductive material laid therebetween. A front glass having a fluorescence coating on its inside is placed to confront the electrode-application area. Cooling water is circulated in the electrode-application area for cooling the divisional electrode pieces. A multi-poled magnet sheet arranged outside the electrode-application area is aligned with the electrode-to-electrode space. Lower frequency power supplies are connected to the divisional electrodes to supply that with voltages of the same amplitude. The power supplies are connected in the form of a star and are connected to a controller for controlling the frequency, amplitude and phase of the voltage wave. The power supply uses an insulation transformer to float the voltages appearing at the output terminals. Thus, an electric discharge appears exclusively among divisional electrodes.

16 Claims, 17 Drawing Sheets

PHASE-CONTROLLED, MULTI-ELECTRODE TYPE OF AC DISCHARGE LIGHT SOURCE

TECHNICAL FIELD

The present invention relates to a new light source using electric discharges for producing weakly-ionized, low-temperature plasma of high density and large volume. Such plasma can be provided effectively in a stable state according to the present invention.

BACKGROUND ART

Conventional light sources for illumination radiate the light from filaments such as tungsten wires which are incandescently heated at an elevated temperature, and the light emitted from atoms, molecules or ions excited in a gas such as vaporized mercury, in which electric discharges appear.

The incandescent light has a good color rendering, but has not a good electric-to-optical conversion rate (or light producing efficiency).

The discharging type of light source works at an increased efficiency, but has a poor color rendering.

The quantity of electricity consumed for civil use is about 15% of the total quantity of electricity consumed in the world. Therefore, with a view to saving electric energy the development of the new light source has been directed mainly to the electric discharging type of light source, which is capable of producing the light at an increased efficiency.

Gas laser-devices in which gases are employed as a laser medium use excitation by electric discharges, particularly glow discharges.

However, the composition of the gas is limited, and the pressure of the gas at which the glow discharge can appear in a stable state is limited, also.

To increase the power and efficiency of the gas laser, it is necessary to excite the gaseous medium at an increased density by an external energy source, for an example, by a beam injection of high energy electrons.

Such equipment, however, is complicated in structure, and good maintenance of the equipment is required.

The gas laser produces the electric discharge of increased electric current, and accordingly the associated forced-cooling system is large in size.

As for a conventional optically-pumped laser, an arc lamp tube or xenon flash lamp tube is used for pumping a laser medium. For the purpose of increasing the light emitting efficiency, the lamp is placed at one of the focuses of an elliptical reflector and the laser medium is placed at the other focus of the elliptical reflector.

To increase the light emitting efficiency, and hence the output of such an optically-pumped laser it is necessary to encircle the laser medium by plural excitation lamps.

When the pumping lamps are made to turn on, their substantial portions are heated at an elevated temperature, and therefore, such pumping lamps and laser medium are put in water for cooling.

The optically pumped laser equipment, therefore, is complicated in structure, and is difficult in handling and maintenance.

Still disadvantageously pumping lamps are short in life, and inconveniently they cannot be changed without removing the laser medium.

A phase-controlled, multi-tapping ac power supply is known. It can provide a phase-controlled, ac power of low frequency, and is appropriate for use in producing an electric discharge of large volume (weakly-ionized, low-temperature plasma) in a stable state with low costs (see Japanese Patent Laid-Open No. H-8-330079). Also, an electrode assembly which is used with the phase-controlled, multi-taping ac power supply to produce an electric discharge at an increased efficiency is shown (see Japanese Patent Laid-Open No. H-10-130836). A method of establishing a multi-poled magnetic field is also known (see Japanese Patent Laid-Open No. H-10-134994).

The electrode assembly comprises a plurality of electrode pieces fixed to the cooled inner wall of the equipment via an intervening sheet of thermally conductive, electrically insulating material whereas the multi-poled magnetic field can be established in the vicinity of each electrode piece by a plurality of magnets, which are fixed to the outer wall of the equipment, thereby confining the plasma in the vicinity of each electrode piece.

SUMMARY OF THE INVENTION

One object of the present invention is to provide an electric discharging type of illumination apparatus which is capable of producing light of increased power, still saving the required energy. The illumination apparatus comprises a gas laser, a phase-controlled, multi-tapping ac power supply and an electrode assembly in combination. The electrode assembly is attached to the inner wall and the magnet assembly for establishing a multi-poled magnetic field is attached to the outer wall of the equipment.

Another object of the present invention is to provide a flash lamp simple in structure, easy in maintenance, and long in life, and is capable of working at an increased efficiency, and of providing an increased power of light.

To attain these objects a phase-controlled, multi-electrode type of AC discharge light source according to the present invention comprises: a plurality of electrode pieces arranged laterally and fixed to the electrode-application area inside of the electric discharge chamber with an insulation layer laying between the electrode pieces and the electrode-application area; multi-pole magnetic field establishing means provided outside of the electric discharge chamber to establish the multi-pole magnetic field on the surface of each electrode piece, thereby confining the electric discharge in the vicinity of the electrode piece; and a phase-controlled, multi-tapping ac power supply connected to the electrode pieces for producing light in the electric discharge chamber.

A phase-controlled, multi-electrode type of AC discharge light source is so constructed that it further comprises cooling means placed outside of the electric discharge chamber for cooling the electrode pieces.

A phase-controlled, multi-electrode type of AC discharge light source is so constructed that the electric discharge chamber has a light-transparent object placed ahead of the electrode pieces.

A phase-controlled, multi-electrode type of AC discharge light source may be so constructed that the electrode-application area is flat.

A phase-controlled, multi-electrode type of AC discharge light source may be so constructed that the electrode-application area is concave.

A phase-controlled, multi-electrode type of AC discharge light source may be so constructed that the electrode-application area is semi-spherically concave.

A phase-controlled, multi-electrode type of AC discharge light source may be so constructed that the electrode pieces are formed by printing and sintering an electrically conductive material onto the electrode-application area.

A phase-controlled, multi-electrode type of AC discharge light source may be so constructed that the electrode pieces are formed by plasma-spray coating an electrically conductive material onto the electrode-application area.

A phase-controlled, multi-electrode type of AC discharge light source may be so constructed that the multi-pole magnetic field establishing means comprises a thin magnetic sheet having a stripe pattern magnetized alternately with north or south pole, thereby establishing the multi-pole magnetic field on the surface of each electrode piece.

A phase-controlled, multi-electrode type of AC discharge light source may be so constructed that the multi-pole magnetic field establishing means comprises a plurality of magnet strips alternately magnetized in north or south pole, the magnet strips being laterally arranged closely to each other, thereby establishing the multi-pole magnetic field on the surface of each electrode piece.

A phase-controlled, multi-electrode type of AC discharge light source may be so constructed that the phase-controlled, multi-tapping ac power supply is a four-phase ac power supply.

A phase-controlled, multi-electrode type of AC discharge light source according to the present invention comprises: a plurality of electrode pieces arranged laterally and fixed to the electrode-application area of the inner wall surface of the electric discharge chamber with an insulation layer lying between the electrode pieces and the electrode-application area, the laser gas being circulated and cooled in the electric discharge chamber; cooling means for cooling the electrode pieces; multi-pole magnetic field establishing means for establishing the multi-pole magnetic field on the surface of each electrode piece, thereby confining the electric discharge in the vicinity of the electrode piece; and a phase-controlled, multi-tapping ac power supply connected to the electrode pieces for producing the light in the electric discharge chamber.

A phase-controlled, multi-electrode type of AC discharge light source comprises: reflection condenser mirror means placed outside of the laser medium, the reflection condenser mirror means having a light-transparent object placed on its front side, a plurality of electrodes laterally arranged on the surface of the reflection condenser mirror means to delimit the electric discharge chamber; cooling means placed outside of the electric discharge chamber for cooling the electrode pieces; multi-poled magnetic field establishing means for establishing the multi-poled magnetic field on the surface of each electrode piece, thereby confining the electric discharge in the vicinity of the electrode piece; and a phase-controlled, multi-tapping ac power supply connected to the electrode pieces for producing the light in the electric discharge chamber.

A phase-controlled, multi-electrode type of AC discharge light source may be so constructed that the reflection condenser mirror means is flat.

A phase-controlled, multi-electrode type of AC discharge light source may be so constructed that the reflection condenser mirror means is concave.

A phase-controlled, multi-electrode type of AC discharge light source may be so constructed according to claim 16 that the reflection condenser mirror means is formed on the inner wall surface of the circular cylinder.

BEST MODE FOR CARRYING OUT THE INVENTION

Figure 1:
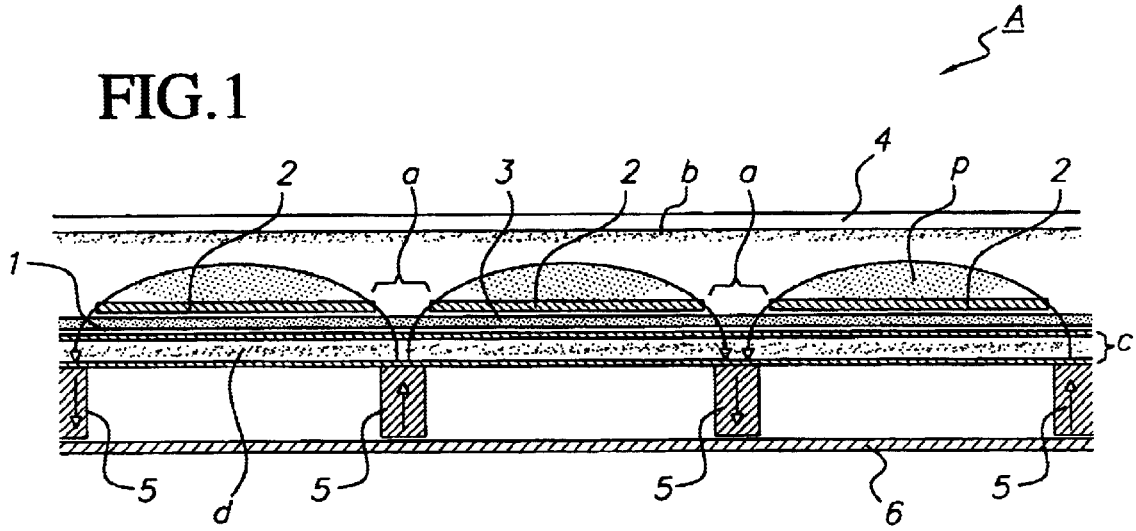
FIG. 1 is a cross section of a part of a flat light source, in the form of which a phase-controlled, multi-electrode type of AC discharge light source according to the present invention is embodied.

FIG. 1 is a cross section of a part of a flat light source, in the form of which the present invention is embodied.

Like a plasma display or an EL plate the flat light source A is flat in appearance, and it has "n" thin, divisional electrode pieces 2 arranged longitudinally at narrow intervals "a" and laid on an electrode-application area 1, which is defined on the bottom of the flat container. A sheet of insulation 3 of good electrically insulating and thermally conducting material is laid between the electrode-application area 1 and the divisional electrode pieces 2.

Electrode pieces 2 are so sized that all of the electrode pieces may occupy the whole area of the electrode-application area 1.

The inner surface of the front glass 4 facing the electrode-application area 1 is coated with fluorescent material "b".

A double-walled floor "c" lying under the electrode-application area 1 permits the cooling water "d" to flow and cool the overlying electrode pieces 2.

Figure 22:
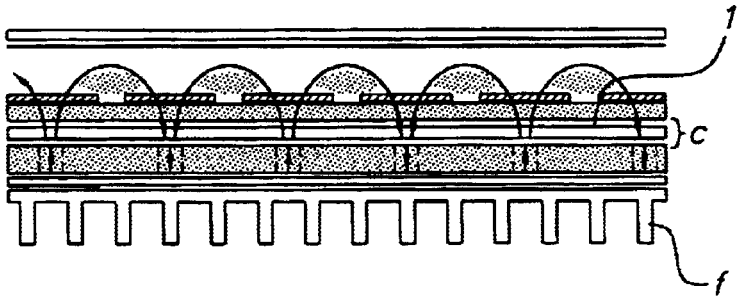
FIG. 22 is a cross section of a part of a flat light source having fins fixed outside.

The double-walled floor "c" may have heat-radiating fins "f" fixed to its lower surface, as shown in FIG. 22.

N+1 rod magnets 5 are arranged on the lower surface of the double-walled floor "c" to be in alignment with the electrode-to-electrode space "a", alternating N pole and S pole as indicated by arrows.

With this arrangement the lines of magnetic force traverse each electrode piece 2.

Electromagnetic coils may be used in place of permanent magnets.

Also, a sheet of magnets 5 such as a rubber sheet magnet may be applied to the front or rear side of the sheet of insulation 3 to provide a required multi-poled magnetic field.

A magnetic shield plate 6 is applied to the arrangement of magnets 5 installed on the lower surface of the double-walled floor "c".

In FIG. 1 the magnets 5 are so arranged below the divisional electrode pieces 2 that they may be in alignment with the electrode-to-electrode spaces "a", although the magnets 5 can be placed otherwise relative to the divisional electrode pieces 2.

Each divisional electrode piece 2 is covered by the magnetic field. Thus, the plasmas when appearing above the divisional electrode piece 2 can be effectively confined in the vicinity of the divisional electrode piece 2.

Figure 23:
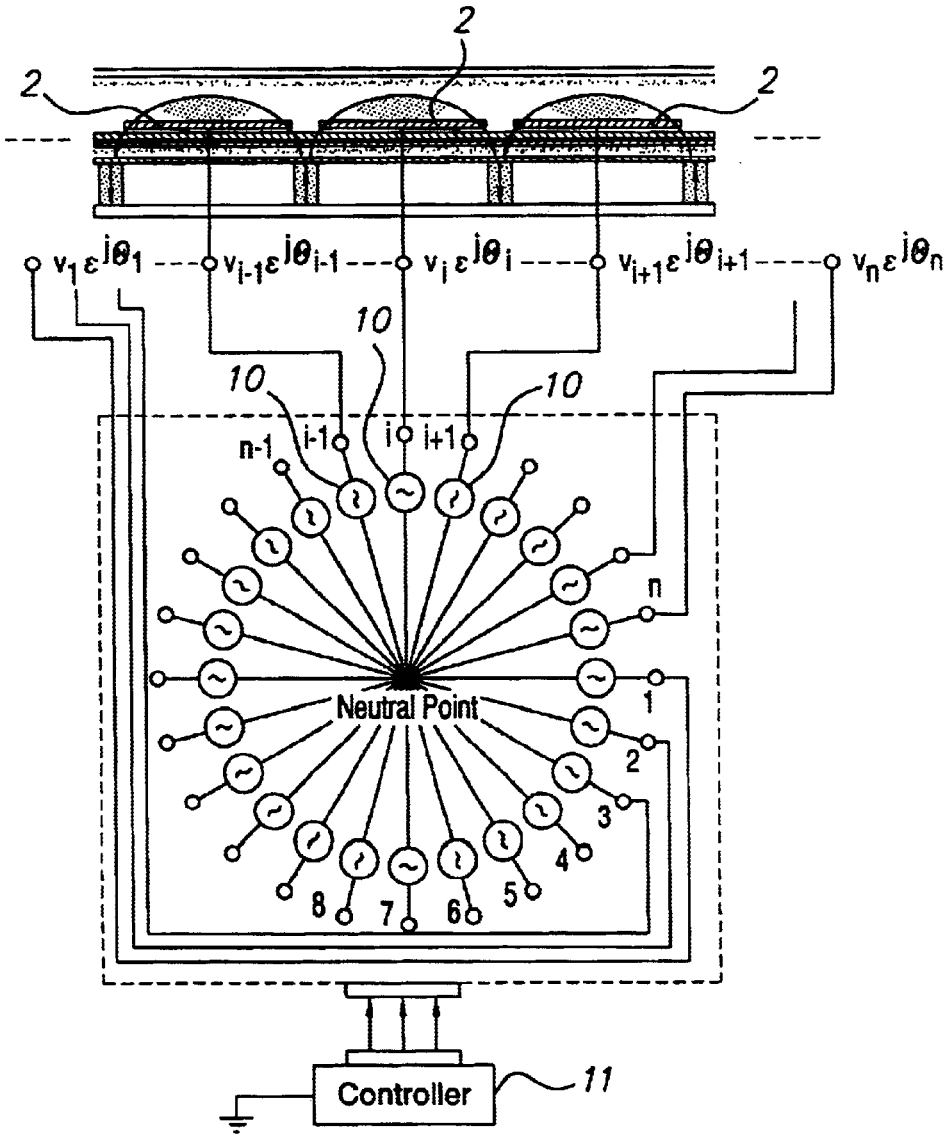
FIG. 23 shows how the flat light source is connected to a power supply.

As shown in FIG. 23, the "n" divisional electrode pieces 2 are connected to "n" sub-power supplies 10, which can provide each divisional electrode piece 2 with 1/n out-of-phase voltage of equal amplitude.

The frequencies, phases (including wave shapes) and amplitudes of the potentials appearing at the output terminals of the "n" sub-power supplies 10 are controlled by a controller 11. These sub-power supplies are star-connected together, and their potential remain floating by using insulation transformers, allowing an electric discharge to appear only among electrode pieces 2.

The flat illuminating apparatus A is constructed as described above. It is evacuated, and then, it is filled with a mixture gas of several hundred torr. The mixture gas contains several percent of He or Xe.

The "n" divisional electrode pieces 2 are connected to the "n"-tapping, phase-controlled ac power supply of one or less kilowatts for electric discharging.

As shown in FIG. 1, a plasma P is caused by a glow discharge to be confined in the vicinity of each electrode piece 2 by the magnetic field.

When the "n"-phased ac voltages are applied to the "n" divisional electrode pieces 2, the electric discharge rounds from electrode to electrode once per period, and therefore, the electric discharge rounds as many times as the frequency per second.

The electric discharge appears among any of electrode pieces all the time, thus producing a continuous electric discharge like a high-frequency discharging in spite of a low-frequency discharging.

The electric discharge causes radiation of ultraviolet rays from Xe atoms, and when striking against the fluorescent coating "b" of the front glass 4 the ultraviolet rays are converted to the visible light.

Figure 2:
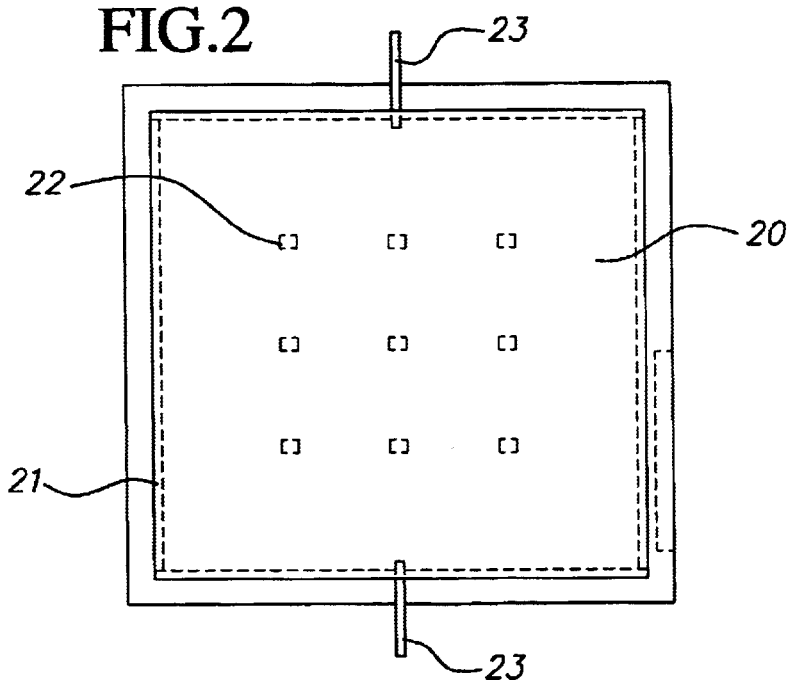
FIG. 2 is a plane view of the flat light source.
Figure 3:
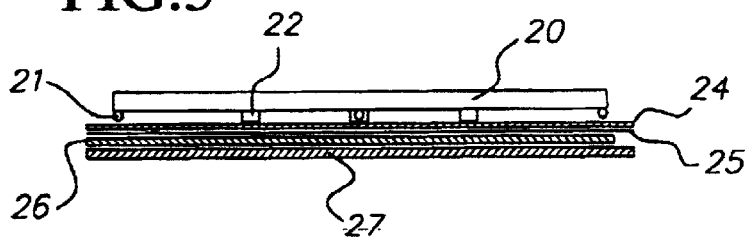
FIG. 3 is a cross section of the flat light source of FIG. 2.

FIGS. 2 and 3 are plane view and cross section of an actual flat lamp.

In these drawings light-transparent glass window 20 whose rear side is coated with a fluorescent substrate is 90×90×3 mm; boundary rod of the frame is 2 mm in diameter; short post 22 is 2 mm in diameter; gas evacuation-and-injection stainless tube 23 is 2 mm in diameter; ceramic electrode-support 24 is 100×100×0.7 mm; polypropylene insulating sheet 25 is 100×100×0.05 mm; rubber multi-poled magnetic sheet 26 is 100×100×1 mm; and soft-iron, magnetic shield plate is 100×100×1.5 mm. The discharge chamber is 86×86×2 mm and the whole size of the flat lamp is 100×100×~8.2 mm.

The electrode-support 24 is bonded to the glass window 20 via glass rods 21 and glass blocks 22 by using ceramic bond, which cannot release undesired gas when being hit with plasma or when being heated by electric discharge.

The glass rods 21 and glass blocks 22 support the glass window 20 against the surrounding atmospheric pressure, which is exerted over the evacuated space for electric discharge. If the glass window 20 is small enough to resist against the surrounding atmospheric pressure, the glass blocks 22 may be unnecessary.

After the electric discharge chamber is evacuated, the so evacuated chamber is filled with a certain electric-discharging gas, and then the pipes 23 are closed by associated valves (not shown).

The electric discharge chamber is cooled spontaneously by heat radiation from the magnetic shield 27, which may be equipped with fins on its outer surface.

Figure 4:
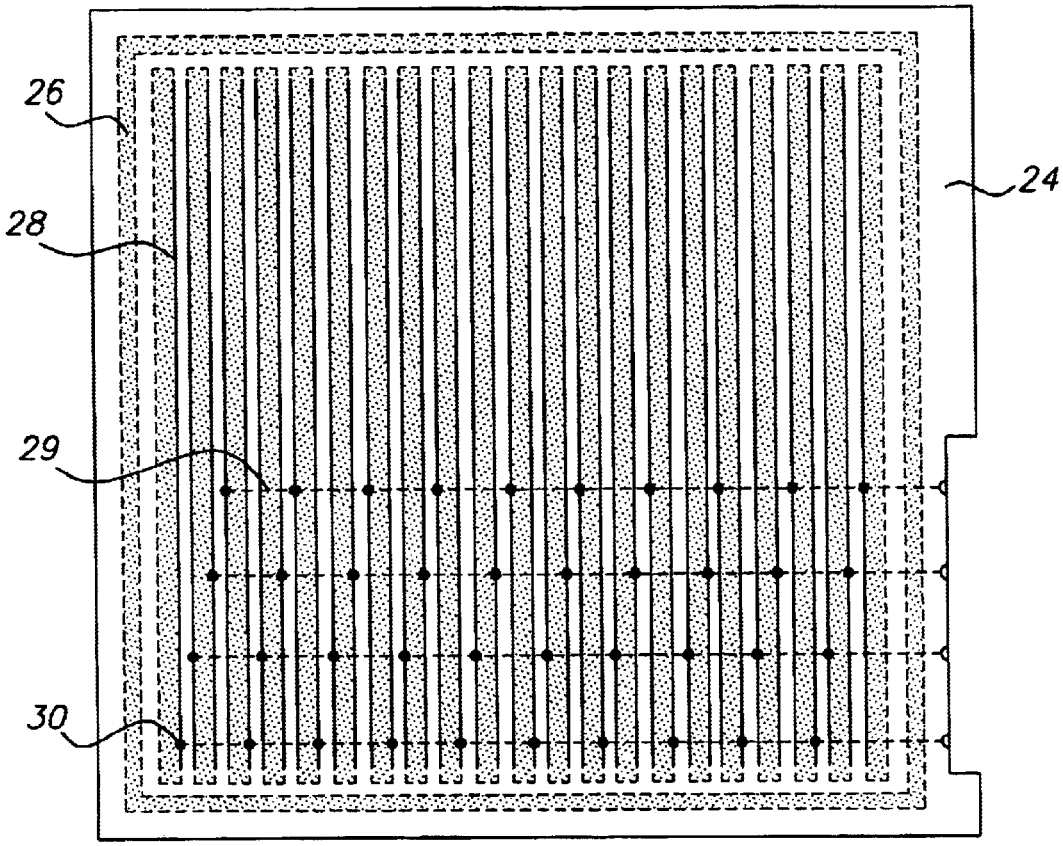
FIG. 4 shows the actual layout of the divisional electrode pieces and the multi-poled magnetic sheet.

FIG. 4 shows an arrangement of divisional electrode pieces and a multi-poled magnetic sheet.

The divisional electrode pieces 28 may be formed by printing and sintering tungsten in the form of stripe pattern on an electrode support. Specifically 40 electrode strips are arranged at the interval of 1.5 mm. Each strip is 78 mm long and 0.5 mm wide.

Assuming that the electric discharge layer to be confined effectively in the magnetic field is approximately 1 mm thick, the magnetizing pitch is approximately 2 mm apart. The divisional electrode piece is preferably as wide as possible whereas the inter-electrode distance is required to be long enough to provide a good electrical insulation between adjacent electrode pieces. As a compromise the electrode is 0.5 mm wide, and the electrode-to-electrode distance is 1.5 mm long.

Four lead wires 29 are printed and sintered on the rear side of the electrode support 24.

Each lead wire 29 is connected to every fourth divisional electrode piece via through holes 30. Thus, ten divisional electrode pieces 28 are connected to a single lead wire 29. As seen from FIG. 4, all divisional electrode pieces are separated in four groups, which are fed with a four-phase voltage source.

The multi-poled magnetic sheet 26 is made as follows: a rubber sheet whose residual magnetic flux density is equal to 2,000 gauss is cut 2 mm wide; the magnetic rubber strips are arranged, alternating N pole and S pole; and the so arranged magnetic rubber strips are glued to the inner surface of the magnetic shield layer 27. Otherwise, a magnetic sheet having N and S alternately poled thereon may be glued to the inner surface of the magnetic shield 27.

Such a magnetic sheet 26 has its strips evenly magnetized with alternate poles.

Distance between centers of adjacent magnetized strips is as wide as the distance of centers of adjacent electrodes (2 mm long distance), and each divisional electrode piece 28 is aligned with either edge of the magnetized strip.

With this arranged each divisional electrode piece 28 is traversed by the arch-like lines of magnetic force (see FIG. 5) so that the plasma P produced by the electric discharge may be effectively confined in the vicinity of the divisional electrode piece 28.

The effective confinement of the plasma is supposed to have the effect of increasing optical conversion efficiency from electricity.

Figure 5:
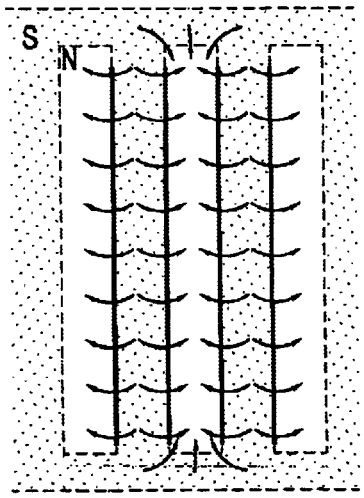
FIG. 5 illustrates how plasmas can be confined under the influence of magnetic field.

The multi-poled magnetic sheet 26 is large enough to extend beyond either end of each divisional electrode piece 28, thereby permitting the lines of magnetic force to pass over either end of each divisional electrode piece 28 (see FIG. 5).

An intervening sheet of insulation 25 is laid between the sheet of electrode support 24 and the multi-poled magnetic sheet 26 to assure the perfect insulation of the lead wires 29 from the multi-poled magnetic sheet 26.

The magnetic sheet 26 and the underlying magnetic shield layer 27 are notched partly on one side to permit access to the lead wires 29 for soldering.

Figure 6:
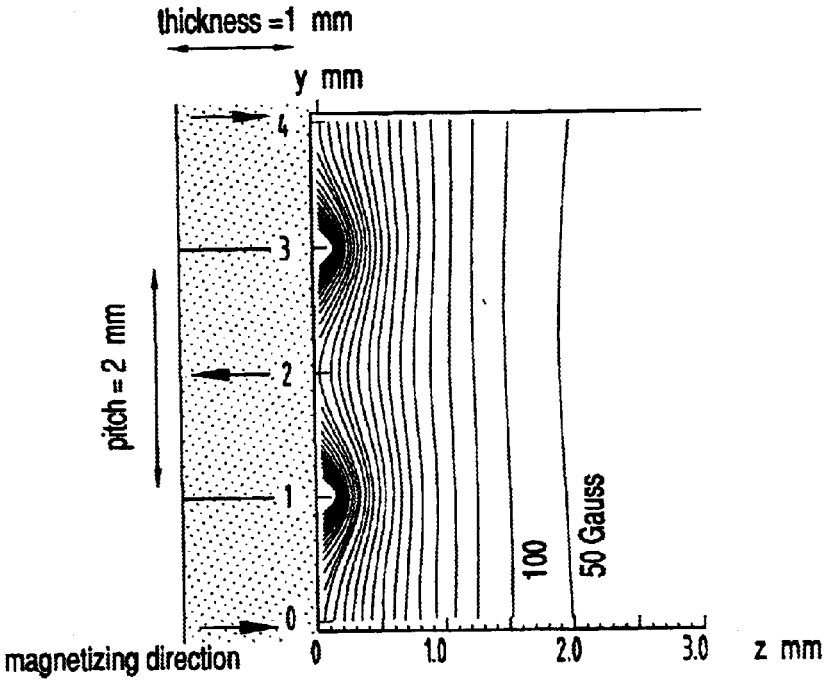
FIG. 6 is a contour line diagram illustrating how the strength of the magnetic field varies on the magnetic sheet.

FIG. 6 shows a theoretically determined contour diagram representing the strength of the magnetic field above the surface of the multi-poled magnetic sheet.

The contour line-to-contour line distance represents 50 gauss; the residual magnetic flux density of the magnetic sheet is 2000 gauss; the magnetic sheet is 1 mm thick, and 20 mm long; and the magnet strip-to-magnet strip distance is 2 mm long.

As seen from the contour line graph, each magnet strip has an increased strength of magnetic force in the vicinity of the magnet strip, and the strength of magnetic force decreases drastically with the increasing of the distance above apart from the magnet strip.

Figure 7:
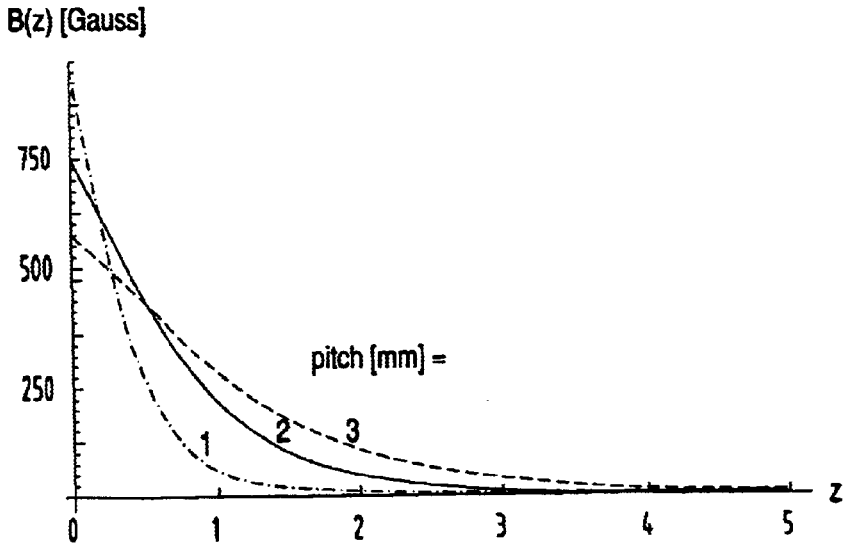
FIG. 7 is a graphic representation, showing how the strength of magnetic field varies with the pitch at which the magnetic sheet is magnetized.

FIG. 7 shows how the strength of the magnetic field varies with the distance "z" above apart from the surface of the multi-poled magnetic sheet. The distance "z" is measured from the center of the magnet strip. The curves 1, 2 and 3 are plotted for different magnetization pitches (mm). The multi-poled magnetic sheet is 1 mm thick. As seen from the graph, the gradient of the curve decreases with the increase of the magnetization pitch. The strength of the magnetic field in the vicinity of the magnet strip decreases with the increase of the magnetization pitch, and the magnetic field extends far increasingly for increasing magnetization pitches. Thus, the distribution of magnetic field depends on the magnetization pitch. It is, therefore, realized that the thickness of the electric discharge layer well confined by the magnetic field is determined by the magnetization pitch.

Figure 8:
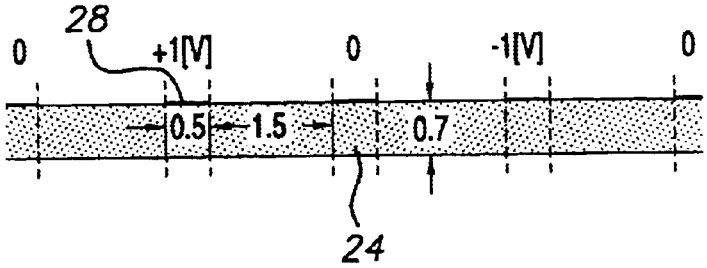
FIG. 8 is a cross section of the circuit board on which electrodes are formed.

FIG. 8 shows, in section, the sheet of electrode support 24, which has an electrode pattern formed thereon. The divisional electrode pieces are to be charged with a four-phase ac power supply. A alumina sheet of 0.7 mm in thickness is used as the sheet of electrode support 24. Each electrode strip is made of tungsten, and is 0.5 mm wide, and 20$\mu$ thick. Distance between centers of adjacent electrodes is 2 mm.

Noise-free electric discharge can be produced by a symmetric poly-phase ac power supply in which each component has the same amplitude and the same phase difference between adjacent components. A symmetric four-phase ac power supply is practically used because of its simple structure.

The frequency is set to be 30 kHz or more so that we can reduce the size of the power supply with the increase of frequency and shift the sonic noise from the high-frequency transformer beyond the audio zone.

The voltage appearing at each terminal is 300 volts high, and is 250 volts high while sustaining the electric discharge.

The output power is 20 watts, remaining in the same order as a table-top fluorescent lamp.

Figure 9:
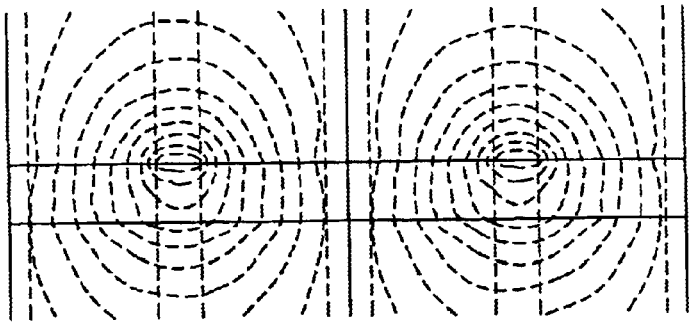
FIG. 9 is a contour line diagram of electric potential in the vicinity of the circuit board on which electrodes are formed.
Figure 10:
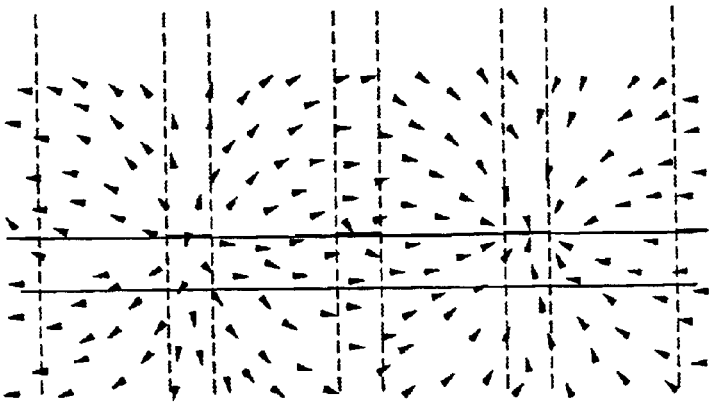
FIG. 10 is a vector diagram, showing how the electric field is developed around each electrode piece.

FIG. 9 shows a contour line diagram of electric potential around the sheet of electrode support and FIG. 10 shows a vector diagram representing the electric field. These are determined by using a two-dimensional, simulator to analyze a static electric field.

It is assumed that the four-phase ac is applied in parallel to the four electrode pieces, and that +1, 0, −1 and 0 volts appear on the four electrode pieces by turns. The frequency is so low that electric field appearing at each moment may be almost static (or dc).

FIG. 9 reveals that electric potential rises to the uppermost at the positive electrode piece and descends to the lowermost at the negative electrode piece, thus drawing the transition from the mountain top to the valley bottom, passing through the electrode piece at zero potential; and that the gradient is large around the positive or negative electrode piece, that is, the lines of electric force converge toward either edge of the electrode piece.

As seen from FIG. 10, the electric field is directed from the positive to the negative potential electrode piece. The electric field is directed in the direction perpendicular to each equi-potential contour line.

When the four-phased ac voltage is applied to divisional electrode pieces, it is supposed that an electric discharge appears among electrodes at intervals of one, not taking account of the influence of the magnetic field.

Figure 11:
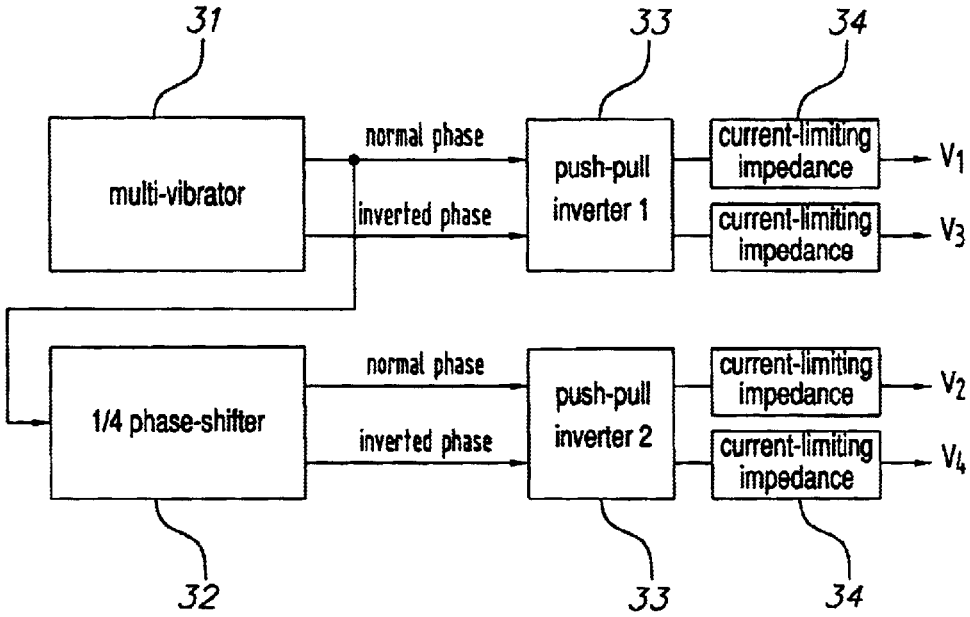
FIG. 11 is a block diagram of a four-phase ac power supply.

Referring to FIG. 11, the four-phased ac power supply comprises a multi-vibrator 31, a ¼ phase-shifter 32 connected to the multi-vibrator 31, two push-pull inverters 33 connected to the multi-vibrator 31 and to the ¼ phase-shifter 32, and four current-limiting impedances 34 connected to the push-pull inverters 33. The current-limiting impedance 34 may be capacitive to save the power loss which would be caused if a resistance were used. The multi-vibrator 31 generates a rectangular wave (alternately and suddenly changing from the positive value to the other negative value), and it generates a first phase control voltage from the positive value and a third phase control voltage from the negative value. The ¼ phase-shifter 32 is responsive to the first phase control voltage from the multi-vibrator 31 for generating a second phase control voltage lagged ¼ phase from the first phase control voltage and for generating a fourth phase control voltage from inversion of the second phase control voltage. The push-pull inverters 33 provide four-phase sinusoidal high-voltages, the current-limiting impedances 34 limit the electric discharge current.

Figure 12:
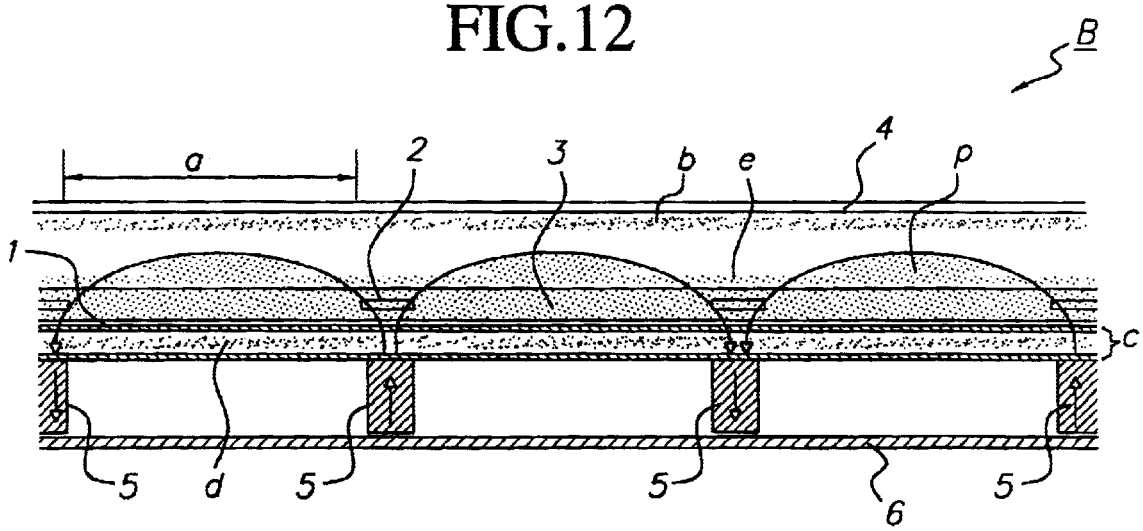
FIG. 12 is a cross section of a part of a flat light source of the barrier electric discharge type, in the form of which the present invention is embodied.

FIG. 12 shows, in section, a barrier electric discharge type of flat lamp. The flat lamp B has "n" divisional electrode pieces 2 arranged at wide intervals "a" and embedded in a sheet of insulation 3. The sheet of insulation 3 is fixed to an electrode-application area 1, which is defined on the bottom of the flat container.

The divisional electrode piece need not be increased in width.

The sheet of insulation 3 is of a good electrically insulating and thermally conductive material such as boron nitride.

A double-walled floor "c" lying under the electrode-application area 1 permits the flow of cooling water "d" to cool the overlying divisional electrode pieces 2.

Rod magnets 5 are arranged on the lower side of the double-walled floor "c" to be in alignment with the divisional electrode pieces 2.

With this arrangement the lines of magnetic force traverse the distance "a" between adjacent divisional electrode pieces.

The divisional electrode pieces 2 are not exposed, and therefore, electric discharge is difficult to be caused. To facilitate appearance of electric discharge the lines of electric force and those of magnetic force are directed in one and same direction.

In place of the rod magnets 5 thin, sheet magnets such as rubber magnets may be laid between the sheet of insulation 3 and the double-walled floor "c" or may be applied to the rear side of the double-walled floor "c" to provide a required multi-poled magnetic field. The thickness of the flat lamp B can be reduced accordingly.

The sheet of insulation 3 is covered by an anti-sputtering film "e", which is made of a material having an increased coefficient of secondary electron emission, such as magnesium oxide.

A magnetic shield plate 6 is applied to the arrangement of magnets 5 in confronting relation with the double-walled floor "c" so that the lines of magnetic force may be confined inside.

In FIG. 12 the magnets 5 are arranged behind the divisional electrode pieces 2, although the magnets 5 can be placed otherwise relative to the divisional electrode pieces 2.

The magnetic flux traverses the inter-electrode distance "a" to make appearance of electric discharges easier.

The flat lamp B is constructed as above. In operation "n"-phase ac voltage is phase-controlled to be applied to the "n" divisional electrode pieces 2, so that barrier electric discharges may appear along the surface of the anti-sputtering cover "e".

Plasmas P caused by such electric discharges are confined within thin spaces by the multi-poled magnetic field, so that collision and excitation of neutral gas molecules may be enhanced by the so confined plasmas. Accordingly the light can be emitted from the neutral gas at an increased density and efficiency.

Figure 13:
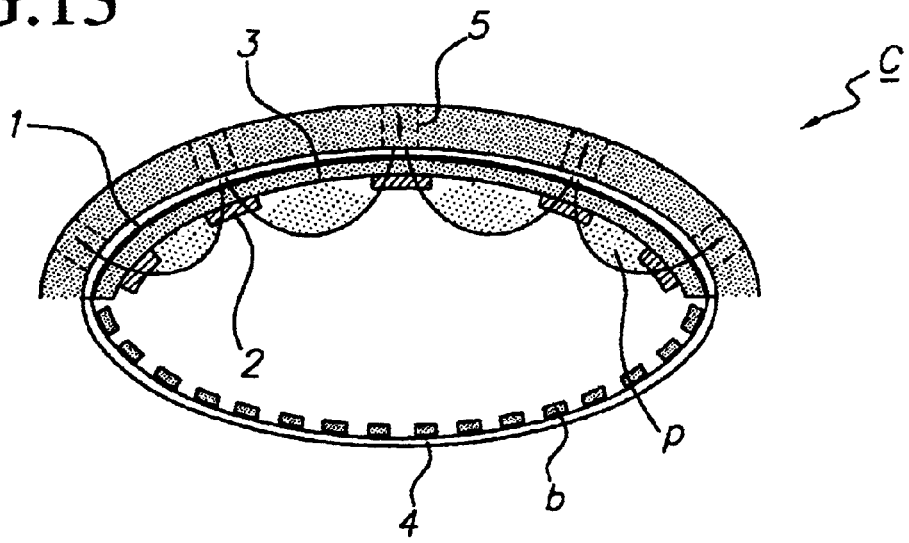
FIG. 13 is a cross section of a flattened-cylindrical light source, in the form of which the present invention is embodied.
Figure 14:
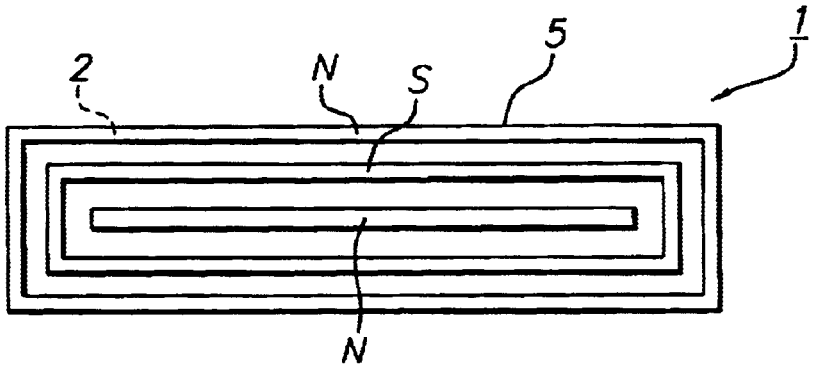
FIG. 14 is a plane view of the flattened-cylindrical light source of FIG. 13.

Referring to FIGS. 13 and 14, a flattened cylindrical lamp C according to the present invention has a plurality of loop electrode pieces 2 arranged like racetracks on the concave electrode-application area 1. These racetrack-like divisional electrode pieces 2 are fixed to the concave electrode-application area 1 via a sheet of insulation 3, which is of a good electrically insulating and thermally conductive material.

A trough-like front glass 4 has a fluorescence coating "b" on its inner surface, and the front glass 4 is fixed to the trough-like electrode-application area 1 in confronting relation.

A multi-poled magnetic sheet has a plurality of strips 5 magnetized in the stripe pattern. It is applied to the outside of the trough-like electrode-application area 1 with its magnet strips 5 aligned with the loop electrodes 2, thus causing the lines of magnetic force to traverse the space between adjacent inner and outer loop electrodes.

The parallel strips 5 are magnetized N or S pole alternately to provide the multi-poled magnetic sheet.

With this configuration the electric discharge appears between adjacent inner and outer loop electrodes 2, and the plasma caused by the electric discharge is confined by the magnetic field so that the efficiency with which the electric energy can be converted to plasma may be improved.

The density of the plasma P thus confined increases, and the plasma P excites the neutral gas increasingly to emit the light from the so excited neutral gas. Finally the efficiency with which the electric energy can be converted to the optical energy is improved.

The electric discharge is liable to appear in conformity with the lines of magnetic force. It is unnecessary that the filament is heated to produce thermal electrons at the start of electric discharge. The filament, which is easy to be wasted, is not required, and the life of the lamp is elongated accordingly.

In order to allow the light emitted from the electric discharge to travel a possible short distance to the fluorescent coating "b" the flattened cylindrical lamp is made as thin as possible, and it is changed in appearance toward an elliptical shape.

When the light travels in the same atmosphere as the electric discharge is made to appear, absorption and re-emission of the travelling light are repeated with the result that the optical energy is partly lost in the form of heat.

The loss of electric energy decreases with the shortening of the distance the light travels, and the optical conversion efficiency of electricity increases.

An electric power supply appropriate for the flattened, cylindrical lamp C can be provided simply by changing a single-phase, ac power supply to a two-phase, ac power supply, which is capable of providing at its output terminals two voltages shifted 90 degrees in phase.

The racetrack configuration of magnetic field confines the plasma P to be in the endless form.

The configurations of electrode array and magnetic field in the flattened, cylindrical lamp C can be changed to fit to a cylindrical or spherical fluorescent lamp without difficulty.

Figure 15:
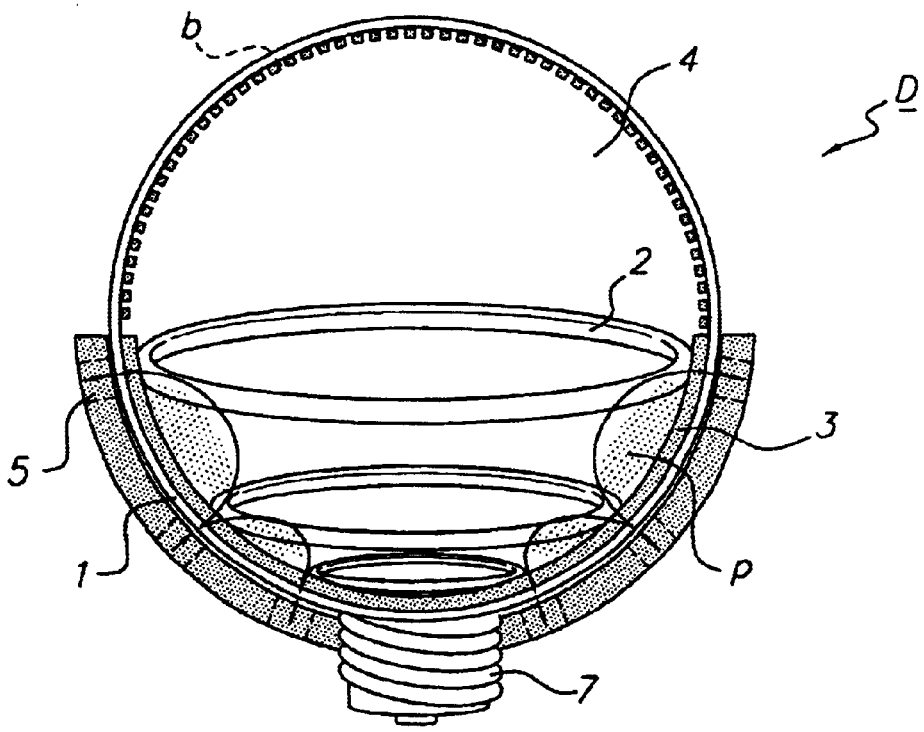
FIG. 15 illustrates a spherical light source, in the form of which the present invention is embodied.
Figure 16:
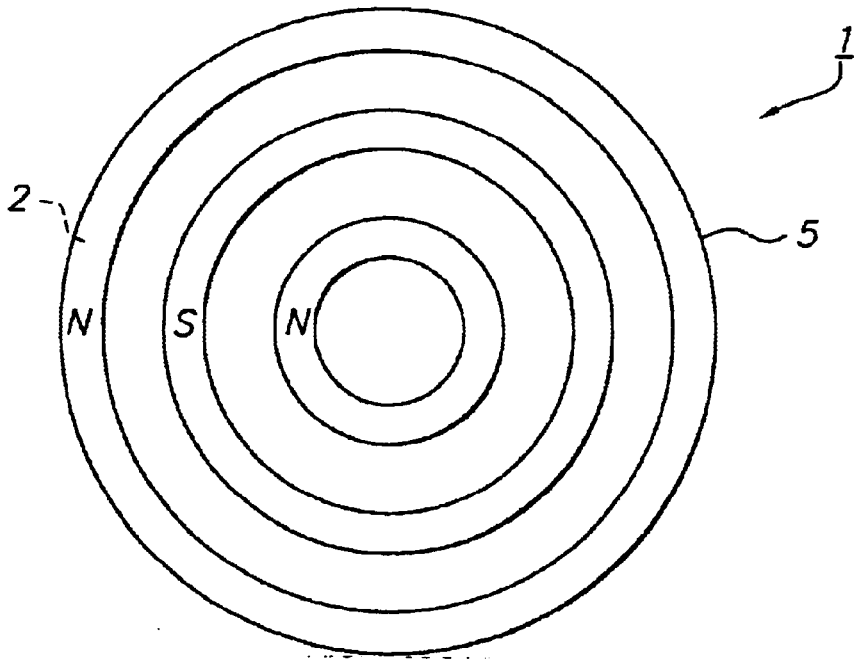
FIG. 16 is a plane view of the spherical light source of FIG. 15.

Referring to FIGS. 15 and 16, a spherical lamp D has a plurality of concentric electrode pieces 2 arranged on its semispherical electrode-application area 1. These concentric divisional electrode pieces 2 are fixed to the electrode-application area 1 via a sheet of insulation 3, which is of a good electrically insulating and thermally conductive material.

A semi-spherical front glass 4 has a fluorescence coating "b" on its inner surface, and the semi-spherical front glass 4 is fixed to the semi-spherical electrode-application area 1 in confronting relation, thus providing a spherical body as a whole.

A multi-poled magnetic sheet having a plurality of concentric strips 5 magnetized therein is applied to the outside of the semi-spherical electrode-application area 1 with its concentric magnet rings 5 aligned with the loop electrodes 2, thus causing the lines of magnetic force to traverse the space between adjacent concentric loop electrodes.

The semi-spherical electrode-application area 1 has a ring contact 7 fixed to its bottom.

An LC circuit for converting a single-phase ac to a two-phase, or 90-degree out of phase ac is installed in the ring contact 7, thereby permitting the ring contact 7 to fit in the socket for which the single-phase commercial ac power is supplied.

The multi-poled magnetic sheet has adjacent concentric rings 5 magnetized N or S alternately, as indicated in FIG. 16.

With this configuration the electric discharge traverses each concentric space between adjacent concentric loop electrodes 2, and the plasma caused by the electric discharge is confined in the latitude by the magnetic field so that the efficiency with which the electric energy can be converted to plasma production may be improved.

Figure 17:
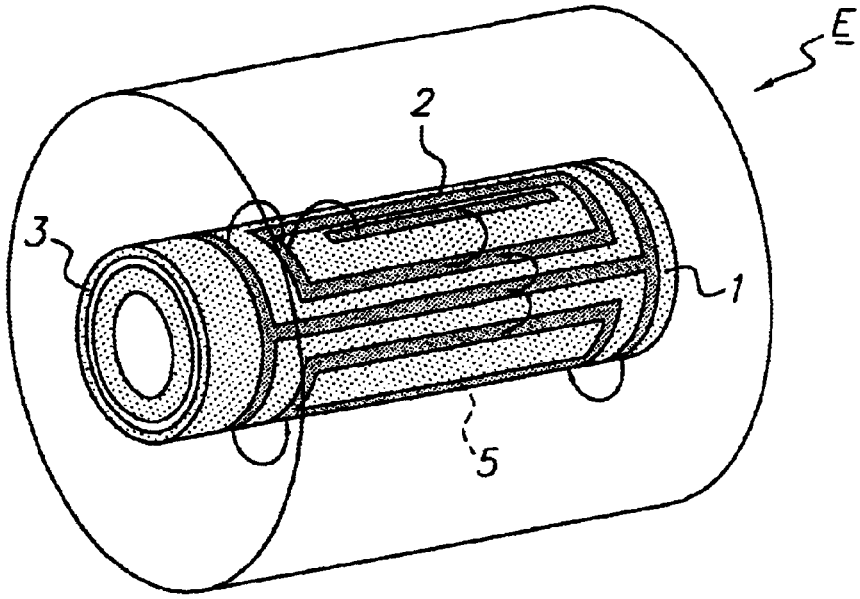
FIG. 17 is a perspective view of a cylindrical fluorescent lamp, in the form of which the present invention is embodied.

Referring to FIG. 17, a cylindrical fluorescence lamp E has a cylindrical electrode-application area 1 inserted in its cylindrical enclosure. The electrode-application area 1 is covered with a sheet of insulation 3, and a plurality of loop electrode pieces 2 each lined with a loop magnet 5 are arranged and fixed onto the cylindrical electrode-application area 1.

The cylindrical electrode-application area 1 is hollow, and therefore, the cylindrical fluorescence lamp can be cooled by natural or forced air-circulation or water circulation so that the lamp may work at an increased power in a stable way.

Figure 18:
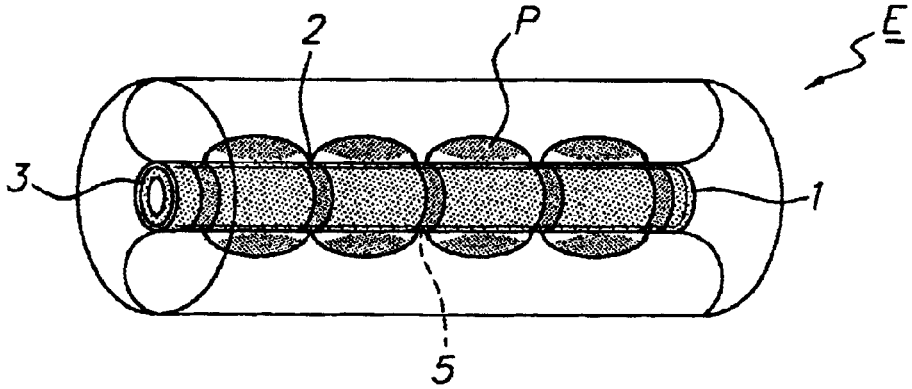
FIG. 18 is a perspective view of a modification of the cylindrical fluorescent lamp of FIG. 17.

FIG. 18 shows a modification of FIG. 17 by changing loop electrode pieces to ring ones.

Figure 19:
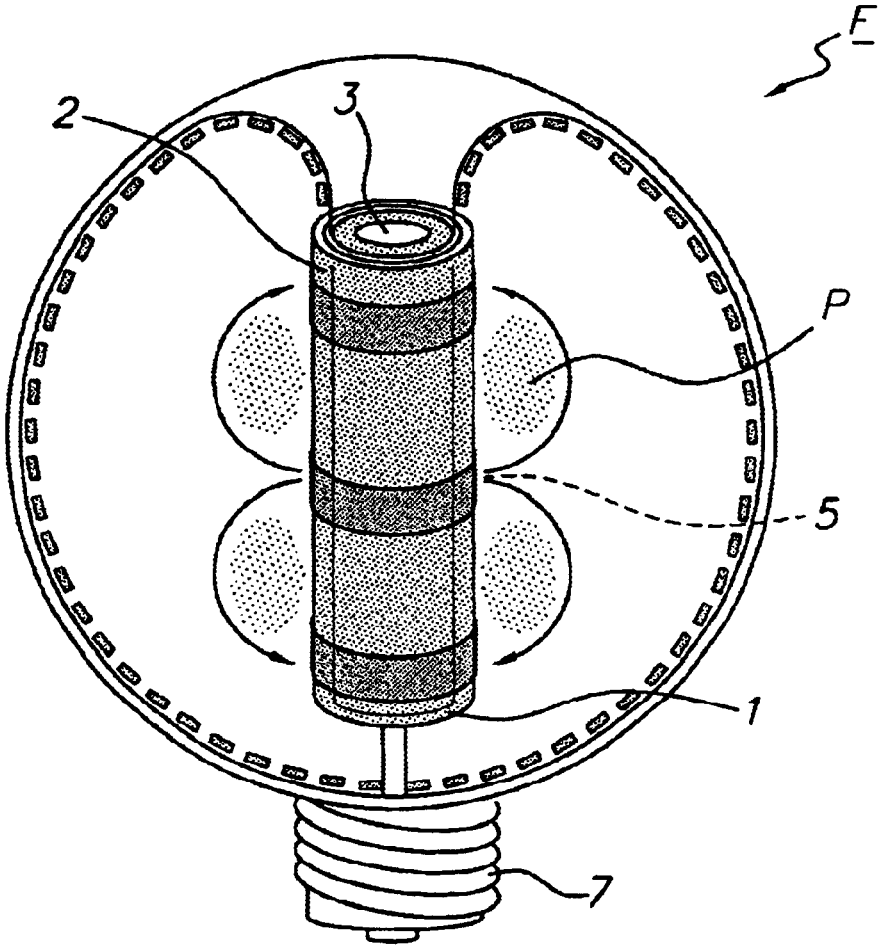
FIG. 19 is a perspective view of a spherical fluorescent lamp, in the form of which the present invention is embodied.

FIG. 19 shows a spherical fluorescence lamp F having a cylindrical electrode-application area 1 inserted in its spherical enclosure. The cylindrical electrode-application area 1 is covered with a sheet of insulation 3, and a plurality of ring electrode pieces 2 each lined with a ring magnet 5 are arranged and fixed onto the cylindrical electrode-application area 1. The spherical body has a ring contact 7 fixed to its bottom.

The cylindrical electrode-application area 1 is hollow, and therefore, the cylindrical fluorescence lamp can be cooled by natural or forced air-circulation or after circulation so that the lamp may work at an increased power in a stable way.

Figure 20:
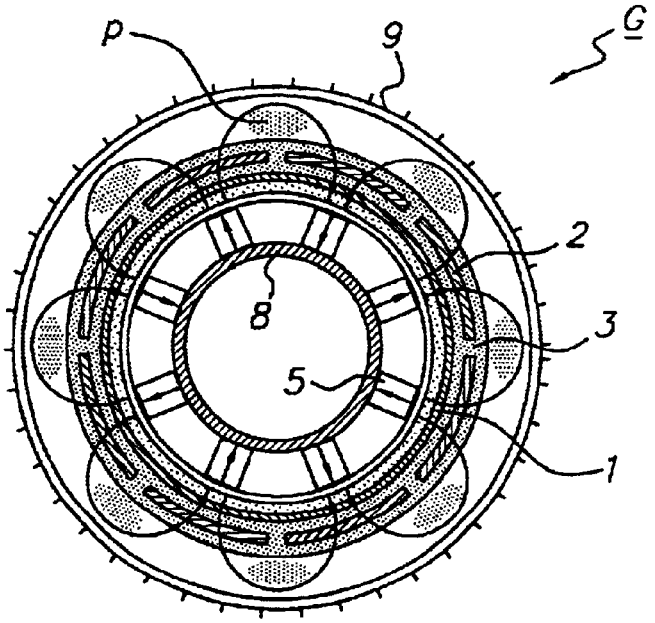
FIG. 20 is a cross section of an excimer lamp of the barrier electric discharge type, in the form of which the present invention is embodied.

FIG. 20 shows, in cross section, a barrier electric discharge type of excimer lamp G according to the present invention, which comprises two concentric inner and outer cylinders 8 and 9 and an intermediate cylinder of insulation 3. The intermediate cylinder of insulation 3 has "n" electrode pieces 2 embedded therein, and "n" magnetic rods 5 are laid between the inner cylinder 8 and the intermediate cylinder of insulation 3. The outer cylinder 9 has a light-transparent or mesh electrode kept to be grounded on its surface.

In a conventional excimer lamp the electric discharge stops when the insulation 3 has been charged with electricity (such charging being caused by the electric discharge) of the quantity enough to suppress the electric discharge, and the electric discharge is allowed to start again when the voltage is reversed in polarity.

In the excimer lamp G of FIG. 20 the divisional electrode pieces 2 are supplied with electricity by a phase-controlled ac power supply so that electric discharges may appear between selected divisional electrode pieces and the outer cylinder 9, which remains at the ground potential. One foot of the traversing electric discharge shifts from electrode piece to electrode piece while the other foot of the electric discharge moves on the inner surface of the outer cylinder, so that the electric discharge appears ceaselessly.

The excimer light is emitted continuously, and accordingly its emission efficiency is higher than the conventional excimer lamp.

Figure 21:
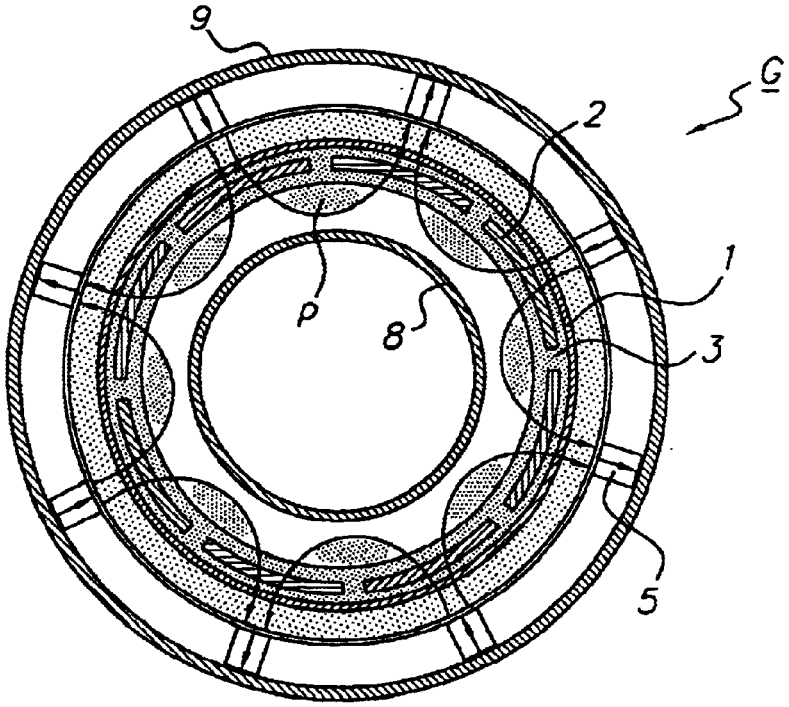
FIG. 21 is a cross section of a modification of the excimer lamp of FIG. 20.

FIG. 21 shows a modification of FIG. 20 by turning inside out.

Figure 24:
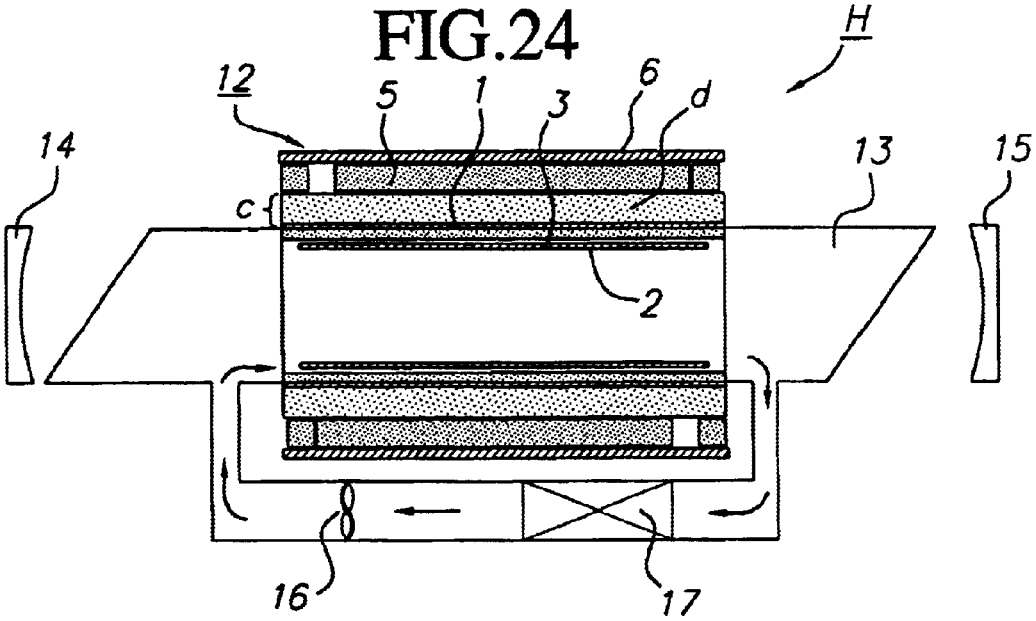
FIG. 24 is a longitudinal section of an electric discharge-pumping laser, in the form of which the present invention is embodied.
Figure 25:
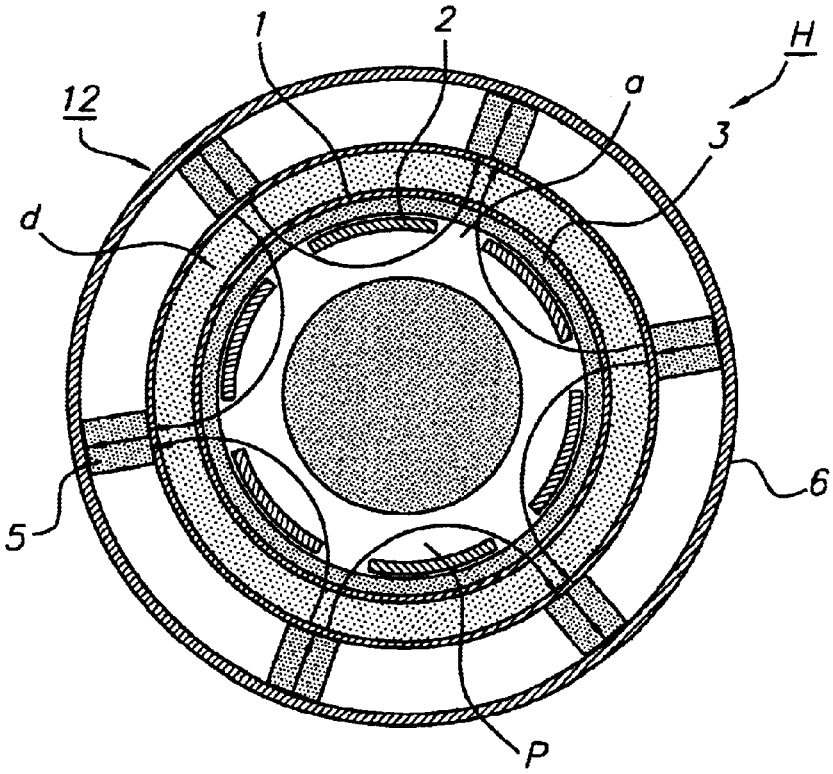
FIG. 25 is a cross section of the electric discharge-pumping laser of FIG. 24.

FIGS. 24 and 25 are longitudinal and cross sections of an electric discharge-stimulated laser system H according to the present invention.

It comprises an electric discharge tube 13 and a cylindrical electric discharge chamber 12 encircling the electric discharge tube 13. Mirror reflectors 14 and 15 are placed on the opposite sides of the electric discharge tube 13, and the electric discharge tube 13 is equipped with a blower 16 and a heat exchanger 17, which are placed in a conduit communicating with the inside of the electric discharge tube 13.

The cylindrical electrode-application area 1 has "n" thin, divisional electrode pieces 2 arranged longitudinally at narrow intervals "a" and fixed thereto via an intervening layer of insulation 3.

The total area of the divisional electrode pieces 2 is increased as much as possible to allow an increased electric discharge current to flow. Accordingly the discharge-stimulation density of the laser is increased.

The electric discharge chamber 12 has a double-walled enclosure "c" for circulating cooling water, thereby cooling the divisional electrodes 2.

This arrangement permits an increased electric discharge current to flow continuously, thereby increasing the discharge-stimulation density of the laser.

The cylindrical electric discharge chamber 12 may have cooling fins attached to its outer surface.

Figure 26:
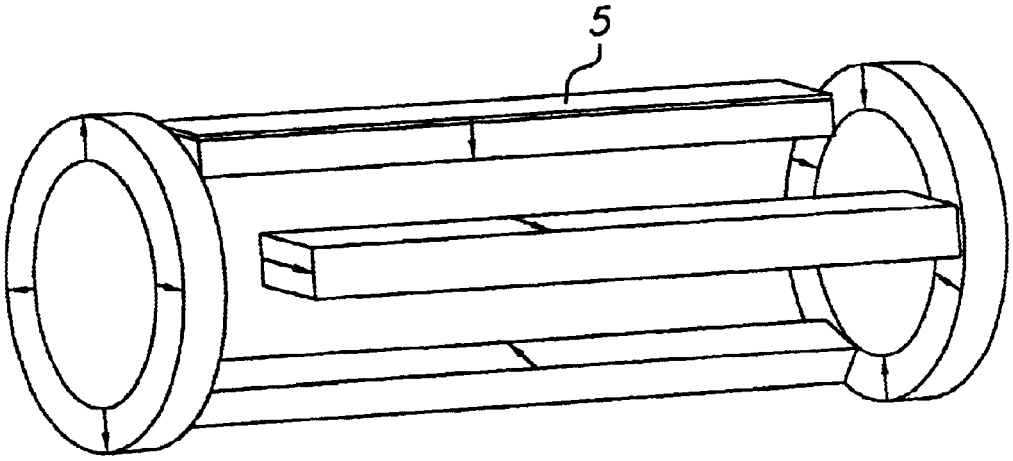
FIG. 26 is a perspective view of arrangement of magnets.

Referring to FIG. 26, magnet rods 5 are so arranged that they may be aligned with the electrode-to-electrode spaces "a", thereby providing the lines of magnetic force traversing the electrode-to-electrode spaces "a". In the drawing arrows indicate the direction of magnetization.

A required multi-poled magnetic field can be provided by electromagnet coils in place of the permanent rod magnets.

The intervening layer of insulation 3 may be lined with a thin sheet of magnet such as a rubber magnet forming a multi-poled magnetic field.

A magnet shield 6 is applied to the circular arrangement of rod magnets 5, which are fixed to the outside of the double-walled enclosure "c".

With this arrangement plasmas P can be effectively confined with the magnetic field, and as a result the stimulation density can be increased in the laser medium.

In this particular embodiment the magnets 5 are placed behind the electrode-to-electrode spaces "a", but the magnets 5 can be placed anywhere other than behind the electrode-to-electrode spaces "a", provided that the divisional electrode pieces 2 be traversed with the lines of magnetic force, thereby effectively confining plasmas P in the vicinity of the divisional electrode pieces 2.

In a case where stimulation of laser medium is insufficient, each divisional electrode piece may be curved to enlarge the area available for electric discharge, and rare earth eternal magnets may be used to increase the strength of the multi-poled magnetic field, and hence the density of the plasma.

The phase and wave shape of the phase-controlled ac power supply may be controlled to meet the oscillation condition, as for instance, follows: when the pulsating oscillation is required, the power supply provides the pulsating voltage waves at its output terminals, and the phases of the pulsating voltage waves are so controlled that the potential difference may exist only between a pair of electrodes in all electrode pieces in the confronting location at a certain instant.

Pulsating electric discharge moves on the circumference of the electrode-application area 1, rotating smoothly as many times as the frequency per second.

When the continuous oscillation is required, the phase and wave shape of the ac power supply is so controlled that the electric discharge may move without a break among the divisional electrode pieces 2.

Continuous electric discharge moves on the circumference of the electrode-application area 1, rotating smoothly as many times as the frequency per second.

Thus, the electric discharge is generated somewhere at any moment, providing the continuous stimulation apparently similar to the stimulation caused by the dc electric discharge in spite of using the ac of low frequency.

No expensive dc power supply is needed to provide the continuous stimulation, which can be attained by using a commercial ac power supply, less expensive than the dc power supply.

Generally while increasing the electric discharge current in the glow electric discharge, it rises suddenly, and then, the glow electric discharge is changed to a local arc discharge.

The multi-tapping, phase-controlled, ac power supply has resistances series connected to its output terminals, so that the ac power supply may be responsive to the drastic increase of electric discharge current for lowering the voltages appearing at the output terminals, thereby preventing the glow discharge from shifting to the arc discharge. Thus, the stable electric discharge can be assured.

Argon, krypton or any other rare gas, nitrogen, carbon dioxide or any other molecular gas, or xenon chloride, krypton fluoride or any other rare gas halide eximer is circulated through the electric discharge tube 13 while being cooled with the blower 16 and the heat exchanger 17.

The divisional electrodes 2 are connected to the multi-tapping, phase-controlled, ac power supply so that the electric discharge may appear from electrode piece to electrode piece in response to application of the phase-controlled ac voltage to the divisional electrode pieces 2.

The electric discharge current flows diametrically in the electric discharge tube 13, traversing the optical axis of the electric discharge tube 13 and the flow of the gas.

In a conventional electric discharge tube whose anode and cathode are placed at its opposite ends, the electrodes need to be so shaped that they may not interfere with the optical amplification or emission of the laser beam, as for instance, they take an annular or cylindrical shape.

Advantageously, the divisional electrode pieces are arranged parallel with the optical axis of the electric discharge tube 13, and therefore, they cannot interfere with the optical amplification or emission of the laser beam.

The electric discharge-stimulated laser H is constructed as above, and its electrode pieces are supplied with electric energy by connecting an "n" tapping, phase-controlled ac power supply of one or less kilowatts.

The glow discharge appears along the electrode-application area 1, thereby stimulating the laser gas within the electric discharge tube 13 to emit the light.

The emitted light is amplified while it travels back and forth repeatedly between the partial mirror reflector 14 and the full mirror reflector 15, thus making a standing wave of light appear therebetween. Thus, the laser oscillation is caused by resonance.

Figure 27:
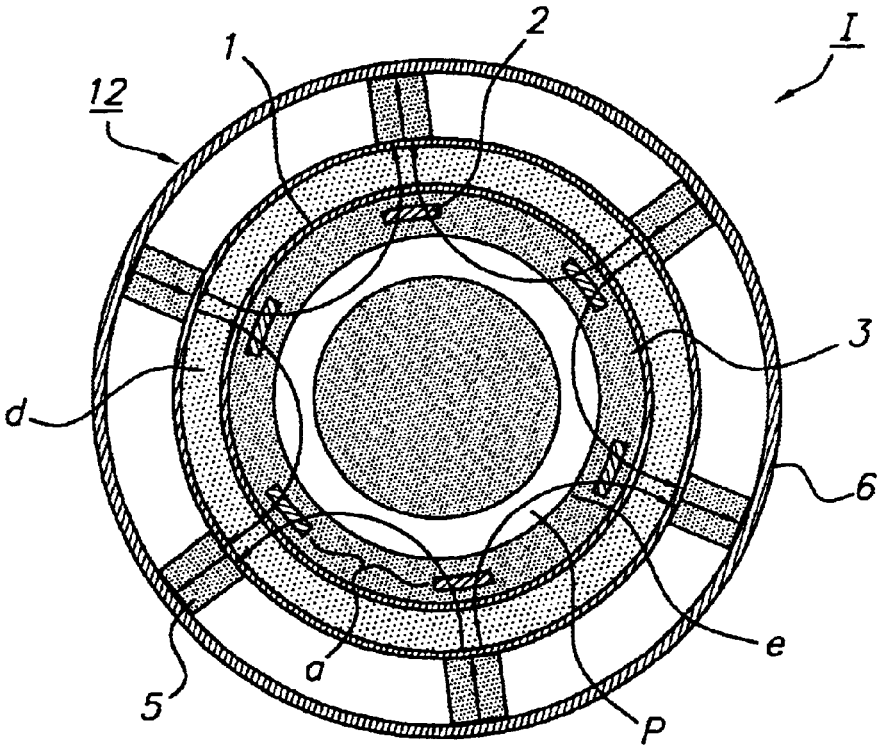
FIG. 27 is a cross section of an electric discharge-pumping laser of the barrier electric discharge type, in the form of which the present invention is embodied.

FIG. 27 is a cross section of a barrier electric discharge-stimulated laser 1 according to the present invention. As seen from the drawing, "n" electrode pieces 2 are arranged axially at relatively wide intervals "a", and embedded within the thickness of a sheet of insulation 3, which is fixed to the electrode-application area 1.

Electrode pieces need not be increased in width.

The sheet of insulation 3 is made of a good electrically insulating and thermally conductive material, such as boron nitride.

The heat generated on the divisional electrode pieces 2 can be removed via the sheet of insulation 3 by the double-walled enclosure "c", where the cooling water "d" is circulated.

A plurality of rod magnets 5 are so arranged on the outer circumference of the double-walled enclosure "c" that they may be behind the divisional electrode pieces 2, thus providing a multi-poled magnetic field whose lines of magnetic force traverse the electrode-to-electrode space "a".

The lines of electric force extend from electrode piece to electrode piece, and the lines of electric force are directed in the same direction as the lines of magnetic force to facilitate appearance of electric discharge from electrode piece to electrode piece.

In place of the rod magnets 5 a sheet of magnet such as a rubber magnet may be sandwiched between the layer of insulation 3 and the double-walled enclosure "c", or otherwise, may be applied to the outer surface of the double-walled enclosure "c". This arrangement permits the significant reduction of the profile of the electric discharge-pumped laser I.

The layer of insulation 3 has an anti-sputtering coating "e" such as magnesium oxide on its surface.

Advantageously the anti-sputtering coating "e" is made of a material whose secondary electron emission coefficient is as large as possible, thereby facilitating appearance of electric discharge.

A magnetic shield 6 surrounds the circular arrangement of rod magnets 5 in the confronting relation with the double-walled enclosure "c" to confine the lines of magnetic force inside.

In this particular embodiment the magnets 5 are placed behind the divisional electrode pieces 2, although the magnets 5 can be placed at any places appropriate for the purpose other than behind the divisional electrode pieces 5.

The positioning of the magnets 5 behind the divisional electrode pieces 2 causes the lines of magnetic force to bridge across the electrode-to-electrode space "a", thereby facilitating appearance of electric discharge thereacross.

The electric discharge-pumped laser I is constructed as mentioned above, and in operation the "n" divisional electrodes 2 are supplied with the "n"-phase ac voltage.

Thus, barrier electric discharges appear along the anti-sputtering coating "e".

The plasma P caused by such electric discharges are confined in the areas delimited by the surrounding multi-poled magnetic field, and therefore, the collision excitation is expedited to raise the laser oscillation efficiency.

Figure 28:
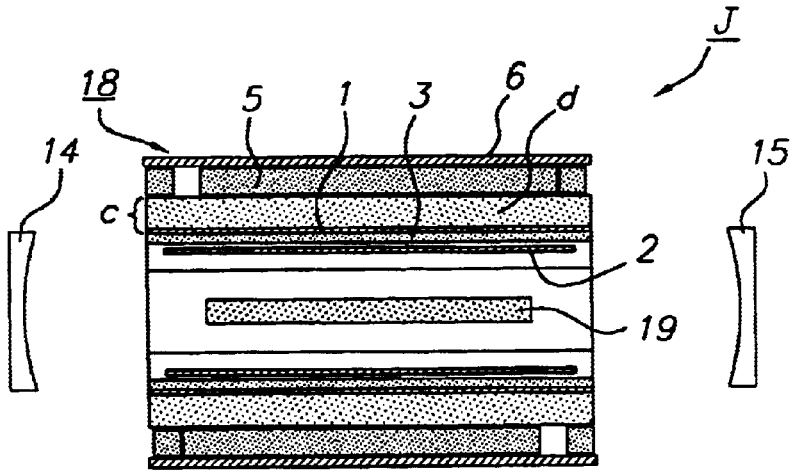
FIG. 28 is a longitudinal section of a flash lamp using a circular cylindrical medium, in the form of which the present invention is embodied.
Figure 29:
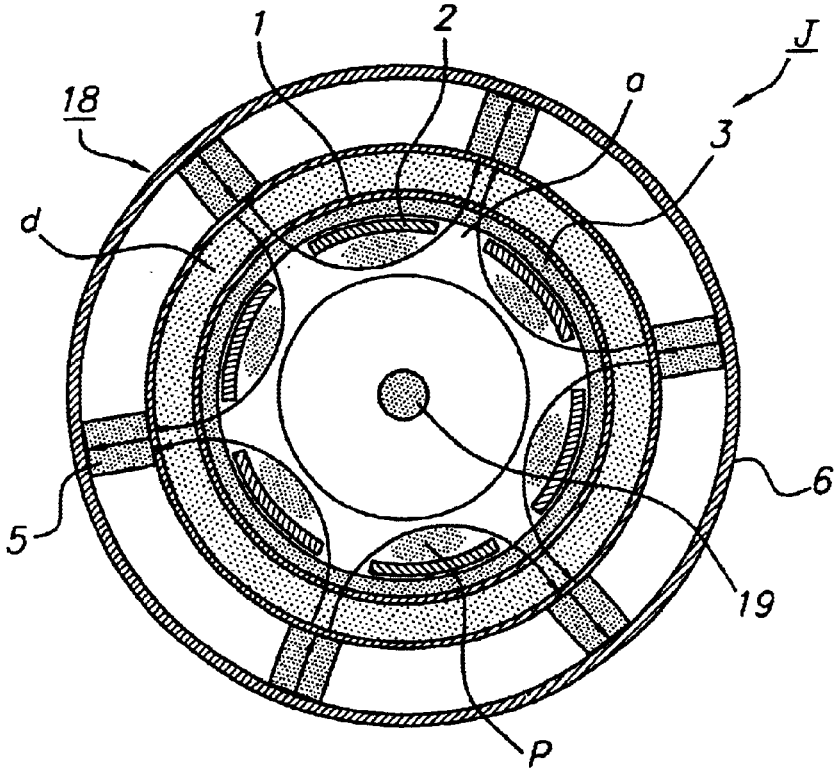
FIG. 29 is a cross section of the flash lamp of FIG. 28.
Figure 30:
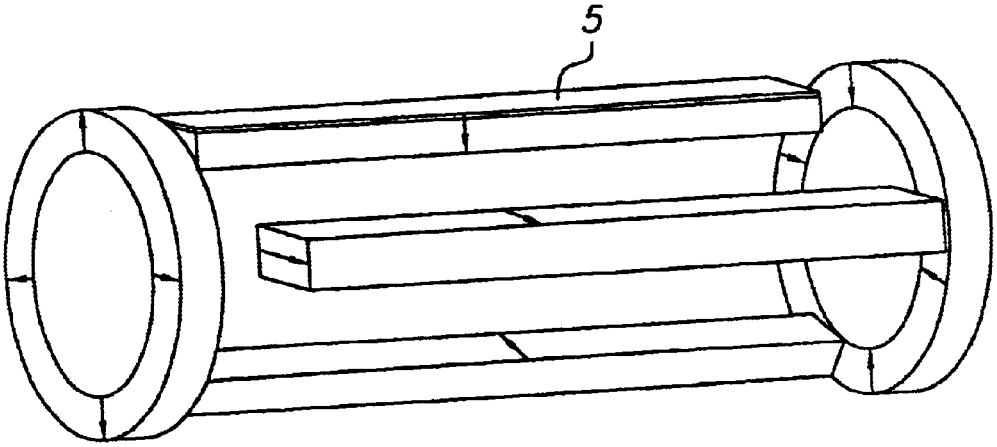
FIG. 30 is a perspective view of arrangement of magnets.

FIGS. 28 and 29 are longitudinal and cross sections of a flash lamp J in which a cylindrical volume of laser medium can be stimulated for light emission.

As shown in these drawings, partial and full reflection mirrors 14 and 15 are placed on the opposite sides of a cylindrical condenser reflection mirror 18. The cylindrical condenser reflection mirror 18 has a cylindrical volume of laser medium 19 on its optical axis.

The cylindrical volume of laser medium 19 may be a cylindrical rod of solid matter or a cylindrical transparent container filled with a pigmentary liquid.

The cylindrical condenser reflection mirror 18 has "n" mirror-polished, divisional electrode pieces 2 arranged axially at intervals "a" attached onto its electrode-application area 1 via an intervening sheet of insulation 3.

The divisional electrode pieces 2 occupy as large as possible area in the electrode-application area 1 to increase the electric discharge current to the possible maximum, and hence the density of light emission to the possible maximum.

The outer circumference of the cylindrical condenser reflection mirror 18 is of a double-walled enclosure "c", in which the cooling water is circulated to cool the divisional electrode pieces 2.

With this arrangement an increased electric discharge current can flow continuously, thereby permitting stable, continuous emission of light at an increased emission density.

The cylindrical condenser reflection mirror 18 may have fins attached on its outer circumference.

A plurality of rod magnets 5 are attached to the outer circumference of the double-walled enclosure "c" to be behind the electrode-to-electrode space "a", thereby providing a multi-poled magnetic field in which the lines of magnetic force traverse each electrode-to-electrode space "a". The direction in which the lines of magnetic force extend is indicated by arrows.

A required multi-poled magnetic field can be provided by electromagnet coils in place of the permanent rod magnets 5.

Also, a sheet of magnet may be applied to the front or rear side of the sheet of insulation 3.

A magnetic shield 6 is applied to the circular arrangement of the rod magnets 5 in the confronting relation with the outer surface of the double-walled enclosure "c".

With this arrangement plasmas P can be confined within the magnetic field to increase its density, and hence, the density of light emission.

In FIG. 29 the magnets 5 are placed behind the electrode-to-electrode space "a", although the magnets 5 can be placed at any places appropriate for the purpose other than behind the electrode-to-electrode space "a".

The positioning of the rod magnets 5 as such causes the lines of magnetic force to cover each divisional electrode 2, thereby effectively confining the plasma P in the vicinity of the surface of each electrode piece 2.

In case of insufficient light emission the divisional electrode pieces is shaped to be like waveform, thereby enlarging the electric discharging area. Otherwise, the strength of the multi-poled magnetic field is increased by using rare earth permanent magnets, thereby increasing the plasma density and hence, the light emission density.

The phase and wave shape of the ac voltage with which the divisional electrode pieces are supplied are controlled to meet the oscillation condition of the laser medium, as for example, follows:

when the pulsating oscillation is required, the power supply provides voltage pulses at its output terminals, and the phases of the voltage pulses are so controlled that the potential difference may exist only between a pair of electrodes in all electrode pieces in the confronting location at a certain instant.

Pulsating electric discharge moves on the circumference of the electrode-application area 1, rotating smoothly as many times as the frequency per second.

When the continuous oscillation is required, the phase and wave shape of the ac power supply is so controlled that the electric discharge may move without a break among the divisional electrode pieces 2.

Continuous electric discharge moves on the circumference of the electrode-application area 1, rotating smoothly as many times as the frequency per second.

Thus, the electric discharge is generated somewhere at any moment, providing the continuous stimulation apparently similar to the stimulation caused by the dc electric discharge in spite of using the ac of low frequency.

No expensive dc power supply is needed to provide the continuous stimulation, which can be attained by using a commercial ac power supply, less expensive than the dc power supply.

Generally while increasing the electric discharge current in the glow electric discharge, it rises suddenly, and then, the glow electric discharge is changed to a local arc discharge.

The multi-tapping, phase-controlled, ac power supply has resistances series connected to its output terminals, so that the ac power supply may be responsive to the drastic increase of electric discharge current for lowering the voltages appearing at the output terminals, thereby preventing the glow discharge from shifting to the arc discharge. Thus, the stable electric discharge can be assured.

The electric discharge space is separated from the stimulation area by an ultraviolet-transparent partition of for example, quartz. The electric discharge chamber is filled with xenon, krypton, K-Rb or an alkaline metal or mercury vapor. A piece of ruby or glass is put in the stimulation area, or otherwise the stimulation area is filled with a pigmentary liquid such as rhodamine. Such a pigmentary liquid may be pumped to pass through the stimulation area continuously.

The divisional electrode pieces 2 are connected to a multi-tapping, phase-controlled ac power supply so that voltages to be applied to two adjacent divisional electrode pieces 2 are different in phase, thereby causing the potential difference therebetween to allow a glow electric discharge to traverse the space between the adjacent divisional electrode pieces.

The light from the glow electric discharge is reflected by the cylindrical condenser reflection mirror 18 to converge effectively toward the center of the cylindrical lamp. Thus, the total of the light converging toward the center is equal to or larger than the quantity of the light from the arc discharge in a conventional flash lamp even though the density of light emission is smaller than in the conventional flash lamp.

In the conventional flash lamp thermal electrons need to be provided by overheating the filament at the start of electric discharge. Such seeding with thermal electrons is unnecessary in the flash lamp according to the present invention, and therefore, it has no filament for producing thermal electrons. Accordingly the life of the flash lamp is elongated.

Sputtering of electrode pieces is caused while the electric discharge appears. To prevent such sputtering from blackening the light-projecting window of the lamp the divisional electrode pieces are made of a material whose sputtering coefficient is relatively small, such as tungsten or molybdenum.

Also, a piece of solid substance which is capable of absorbing sputtered particles or foreign gas molecules is put in the electric discharge space.

The flash lamp J is constructed as above, and its electrode pieces are supplied with electric energy by connecting an "n" tapping, phase-controlled ac power supply of one or less kilowatts.

The ac glow discharge appears along the electrode-application area 1 on the inside of the cylindrical condenser reflection mirror 18, thereby illuminating a laser medium 19 at the center of the cylindrical condenser reflection mirror 18 evenly by the very strong light from the electric discharge.

Thus, atoms of the laser medium 19 are stimulated, and the light thus emitted is amplified by induced radiation. The resonance of the light is produced when the light travels back and forth repeatedly between the partial mirror reflector 14 and the full mirror reflector 15, thus making a standing wave of light to appear between the confronting mirror reflectors. Thus, the laser oscillation is caused by resonance.

Figure 31:
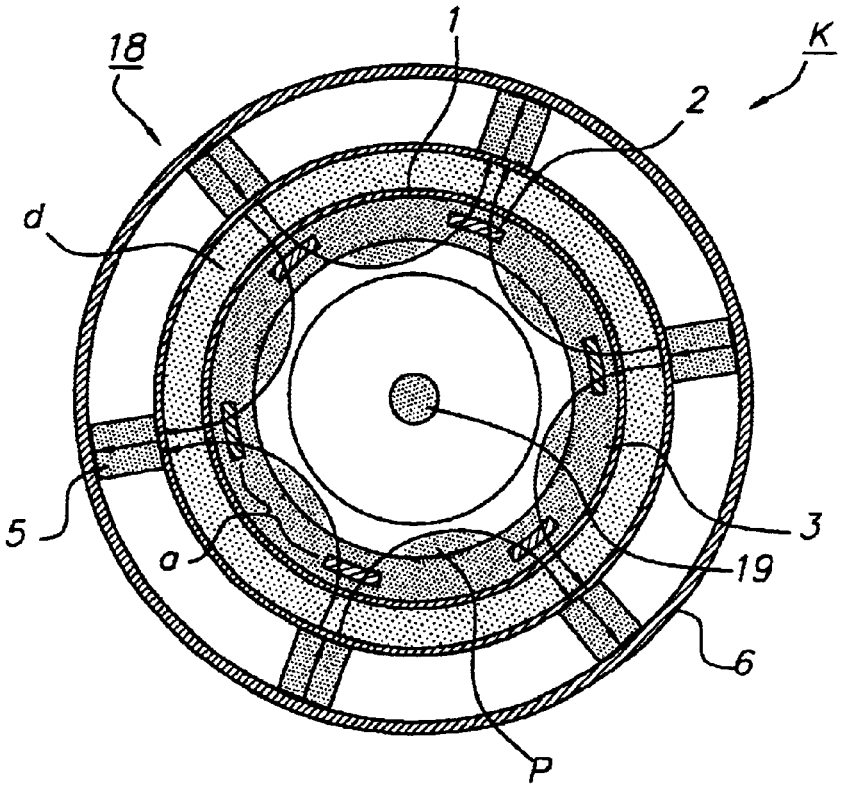
FIG. 31 is a cross section of another flash lamp of the barrier electric discharge type using a circular cylindrical medium, in the form of which the present invention is embodied.

FIG. 31 is a cross section of a barrier electric discharge type of flash lamp K according to the present invention in which a cylindrical laser medium is stimulated by the barrier electric discharge.

In the flash lamp K "n" thin, mirror-polished, divisional electrode pieces 2 are arranged longitudinally, leaving a relatively wide space "a" between adjacent electrode pieces to be embedded in a sheet of insulation 3. The sheet of insulation 3 is attached to an electrode-application area 1, which is delimited on the inner mirror surface of the cylindrical condenser reflection mirror 18. The divisional electrode piece 2 need not be enlarged in width.

The layer of insulation is made of a good electrically insulating and thermally conductive matter, such as boron nitride.

The heat generated on the divisional electrode pieces can be removed via the layer of insulation 3 by the cooling water "d", which flows in a double-walled enclosure "c" surrounding the electrode-application area 1.

Rod magnets 5 are arranged on the outer surface of the double-walled enclosure "c" to be in alignment with the divisional electrode pieces 2.

With this arrangement the lines of magnetic force transverse the electrode-to-electrode space "a".

To facilitate appearance of electric discharges from the divisional electrode pieces which are embedded in the layer of insulation the electric field built by the potential difference between adjacent divisional electrode pieces 2 has its lines of electric force aligned with the lines of magnetic force.

In place of the rod magnets 5 a sheet of magnet such as a rubber magnet may be sandwiched between the layer of insulation 3 and the double-walled structure "c", or otherwise, may be applied to the outer surface of the double-walled structure "c". Thus, the profile of the flash lamp K can be reduced.

The layer of insulation 3 has an anti-sputtering coating "e" such as magnesium oxide on its surface.

Advantageously the anti-sputtering coating "e" is made of a material whose secondary electron emission coefficient is as large as possible, thereby facilitating appearance of electric discharge.

A magnetic shield 6 surrounds the circular arrangement of rod magnets 5 in the confronting relation with the double-walled enclosure "c" to confine the lines of magnetic force inside.

In this particular embodiment the magnets 5 are placed behind the divisional electrode pieces 2, although the magnets 5 can be placed at any places appropriate for the purpose other than behind the divisional electrode pieces 5.

The positioning of the magnets 5 behind the divisional electrode pieces 2 causes the lines of magnetic force to bridge across the electrode-to-electrode space "a", thereby facilitating appearance of electric discharge thereacross.

The flash lamp K is constructed as mentioned above, and its electrode pieces are supplied with electric energy by connecting an "n" tapping, phase-controlled ac power supply. Then, the barrier electric discharge appears along the anti-sputtering film "e".

Plasmas P caused by the electric discharges are confined within narrow areas by the multi-poled magnetic field, thereby effectively expediting collision, stimulation and light emission from the laser medium.

Figure 32:
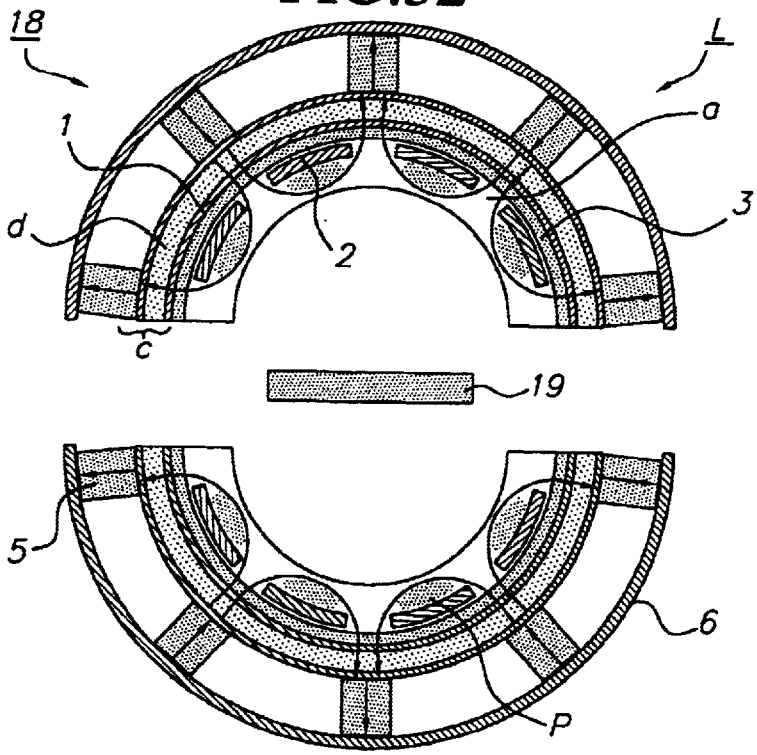
FIG. 32 is a cross section of a flash lamp using a flat-plate medium, in the form of which the present invention is embodied.

FIG. 32 is a cross section of an optically-pumping flash lamp L according to the present invention in which a flat laser medium is optically pumped.

In the flash lamp L a pair of concave condenser reflection mirrors 18 are arranged in confronting relation, and partial and full reflection mirrors (not shown) are arranged longitudinally in confronting relation. A flat laser medium 19 is laid between the confronting concave condenser reflection mirrors 18.

The flat laser medium is a solid matter, or a transparent container filled with a pigmentary solution.

A double-walled structure "c" is formed to delimit the outer surface of each concave condenser reflection mirror 18, and cooling water "d" is made to flow in the double-walled space. The underlying divisional electrode pieces 2 attached to the electrode-application area 1 is cooled via the wall.

The cooling effect thus provided is more effective than the conventional soaking system, and still advantageously no water-tight sealing is required.

The electric discharge space is separated from the stimulating space by a semi-cylindrical structure (or a series connection of semi-cylinders) of a transparent matter such as quartz, which is so constructed as to withstand the inner and outer pressure.

Figure 33:
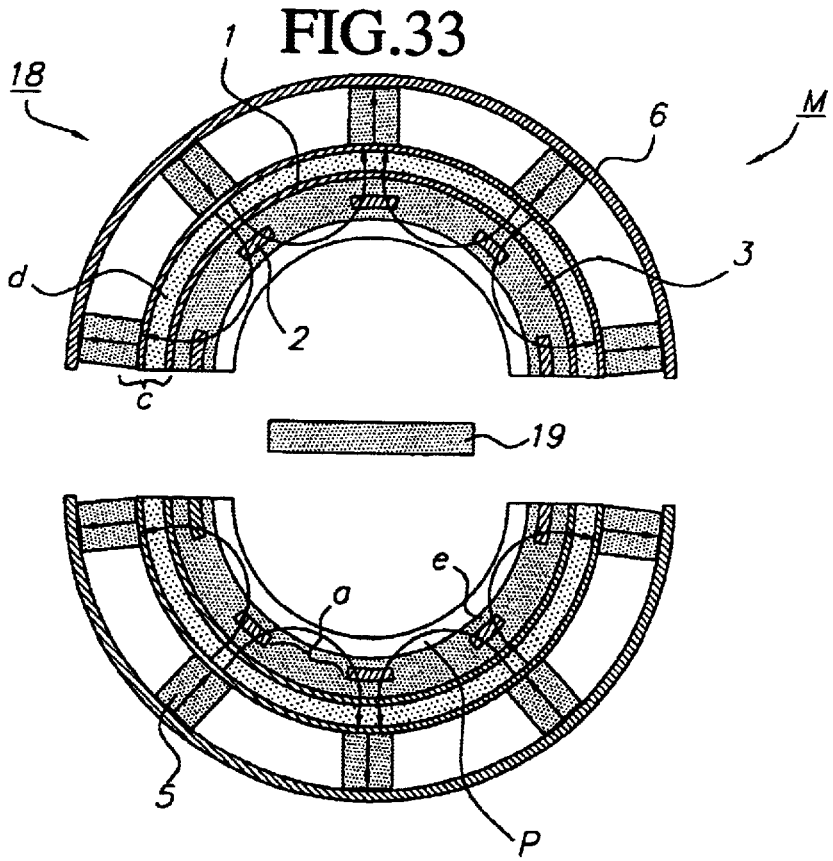
FIG. 33 is a cross section of another flash lamp of the barrier electric discharge type using a flat-plate medium, in the form of which the present invention is embodied.

FIG. 33 shows another barrier electric discharge type of flash lamp M, which is a modification of the flash lamp of FIG. 32 provided by embedding the divisional electrode pieces 2 in the layer of insulation 3.

Figure 34:
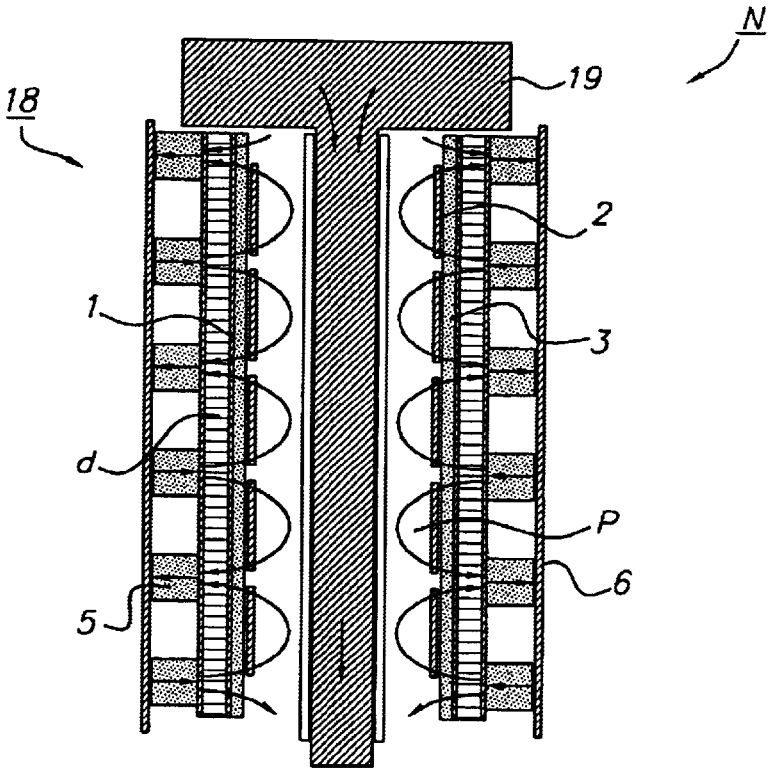
FIG. 34 is a cross section of a flash lamp using a liquid medium, in the form of which the present invention is embodied.

FIG. 34 is a cross section of an optically pumping type of flash lamp N using a liquid laser medium.

In the flash lamp N a pair of flat condenser reflection mirrors 18 are laid laterally in confronting relation, and partial and full reflection mirrors (not shown) are arranged in confronting relation. A laser medium 19 is laid between the confronting condenser reflection mirrors 18.

The laser medium is a transparent container which is filled with a pigmentary solution, or through which the pigmentary solution is circulated.

Figure 35:
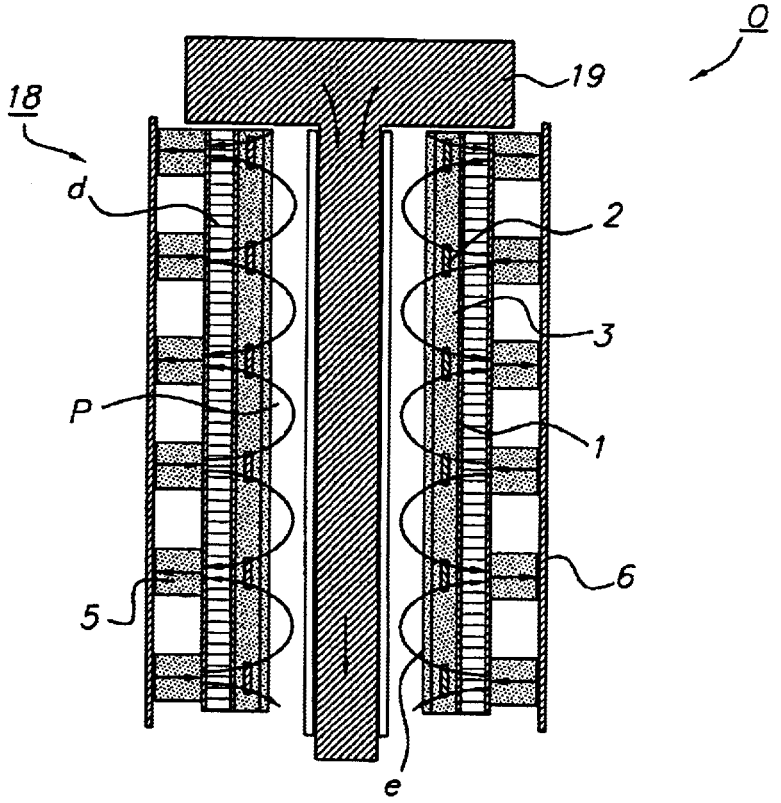
FIG. 35 is a cross section of a flash lamp of the barrier electric discharge type using a liquid medium, in the form of which the present invention is embodied.

FIG. 35 shows another barrier electric discharge type of flash lamp O, which is a modification of the flash lamp of FIG. 34 provided by embedding the divisional electrode pieces 2 in the layer of insulation 3.

INDUSTRIAL APPLICABILITY

As is described above, in a multi-electroded, phase-controlled ac electric discharge light source according to the present invention a plurality of divisional electrode pieces are arranged laterally and fixed to the electrode-application area via an intervening layer of insulation, and a light transparent object is laid in front of the divisional electrode pieces to define an electric discharge chamber. The so defined electric discharge chamber is equipped with cooling means for cooling the divisional electrode pieces, and with means for establishing a multi-poled magnetic field, which can confine the electric discharges in the vicinity of the divisional electrode pieces. These electrode pieces are connected to a multi-tapping, phase-controlled ac power supply to produce light in the electric discharge chamber.

The phases of the voltages to be applied to the divisional electrode pieces are so controlled that an electric discharge may appear among any of the divisional electrode pieces all the time, thereby providing electric discharge-and-light emission continuously in appearance similar to the high-frequency lighting in spite of using the low-frequency, ac electric discharge. Thus, a flicker-less lamp results.

No use of filaments assures its extended life.

According to occasional demands the divisional electrode pieces are arranged and the electric power of the phase-controlled ac power supply is distributed to the divisional electrode pieces. The discharge and the light emission is generated uniformly in a wide area when averaging at time, and a large light emission equipment with a various shape can be made.

Thanks to the effective cooling of the divisional electrode pieces through the outer wall a compact lamp can work a long time while being supplied with an increased electric power.

The multi-poled magnetic field has the affect of confining a plasma within such a limited space that the conversion efficiency of electric discharge to light emission may be improved significantly.

The permanent magnets are attached to the outer surface of the electric discharge chamber. The distance from the outer surface of the electric discharge chamber to the electrode pieces, however, is short enough to establish a magnetic field of good strength in the vicinity of the divisional electrode pieces.

In another multi-electroded, phase-controlled ac electric discharge light source according to the present invention an electric discharge tube is designed to permit a laser gas to circulate while being cooled, and the electric discharge tube has an electrode-application area defined on its inner wall surface. A plurality of divisional electrode pieces are arranged laterally and fixed to the electrode-application area via an intervening layer of insulation, thus providing an electric discharge chamber. The electric discharge chamber is equipped with cooling means for cooling the divisional electrode pieces, and with means for establishing a multi-poled magnetic field, which can confine the electric discharges in the vicinity of the divisional electrode pieces. These electrode pieces are connected to a multi-tapping, phase-controlled ac power supply to stimulate the laser gas in the electric discharge chamber.

The phases of the voltages to be applied to the divisional electrode pieces are so controlled that an electric discharge may appear among any of the divisional electrode pieces all the time, thereby providing glow electric discharges as required for laser oscillation.

The total area of the divisional electrode pieces can be expanded almost to the whole area of the inner wall surface of the electric discharge tube, thus permitting the electric discharge current to increase to the extremity, and accordingly the laser gas medium can be stimulated at an increased density.

The divisional electrode pieces are so close to the wall of the electric discharge chamber that they may be cooled effectively by the surrounding cooling means, and therefore, an increased electric discharge current can be made to flow continuously. Accordingly the laser gas medium can be stimulated continuously at an increased density.

The multi-poled magnetic field established in the electric discharge space has the effect of confining a plasma within such a limited space that the conversion efficiency of electric discharge to light emission may be improved significantly.

In still another multi-electroded, phase-controlled ac electric discharge light source according to the present invention condenser reflection mirrors are arranged around a laser medium, and a light transparent object is laid in front of the condenser reflection mirrors. A plurality of divisional electrode pieces are arranged laterally and fixed to each condenser reflection mirror via an intervening layer of insulation, thus providing an electric discharge chamber. The electric discharge chamber is equipped with cooling means for cooling the divisional electrode pieces, and with means for establishing a multi-poled magnetic field. These electrode pieces are connected to a multi-tapping, phase-controlled ac power supply to produce the light in the electric discharge chamber.

The phases of the voltages to be applied to the divisional electrode pieces are so controlled that an electric discharge may appear among any of the divisional electrode pieces all the time and a spatial uniform discharge and light emission may be generated when averaging at time, thereby projecting the light to the laser medium without interruption.

No use of filaments assures its extended life.

The light emitting area is coplanar with the condenser reflection mirror, and therefore, the condenser reflection mirror can converge the light toward the laser medium effectively.

The cooling of the divisional electrode pieces is performed by carrying the generated heat a possible short distance, that is, through the wall thickness of the electric discharge chamber. Such cooling designing is much more advantageous to construction and operation than the conventional cooling structure in which the stimulation lamp and laser medium are soaked in the cooling water bath.

The multi-poled magnetic field established in the electric discharge space has the effect of facilitating appearance of electric discharge, and of confining a plasma within such a limited space that the conversion efficiency of electric discharge to light emission may be improved significantly.

What is claimed is:

1. A phase-controlled, multi-electrode type of AC discharge light source comprising: a plurality of electrode pieces arranged laterally and fixed to an electrode-application area inside of an electric discharge chamber with an insulation layer lying between the electrode pieces and the electrode-application area; multi-pole magnetic field establishing means provided outside of the electric discharge chamber in the form of a multi-poled magnetic sheet having strips magnetized side by side alternately with N and S poles to establish the multi-pole magnetic field on the surface of each electrode piece, thereby confining the electric discharge in the vicinity of the electrode piece; and a phase-controlled, multi-tapping ac power supply connected to the electrode pieces for producing light in the electric discharge chamber.

2. A phase-controlled, multi-electrode type of AC discharge light source according to claim 1 wherein it further comprises cooling means placed outside of the electric discharge chamber for cooling the electrode pieces.

3. A phase-controlled, multi-electrode type of AC discharge light source according to claim 1 wherein the electric discharge chamber has a light-transparent object placed ahead of the electrode pieces.

4. A phase-controlled, multi-electrode type of AC discharge source according to claim 1 wherein the electrode-application area is flat.

5. A phase-controlled, multi-electrode type of AC discharge according to claim 1 wherein the electrode-application area is concave.

6. A phase-controlled, multi-electrode type of AC discharge according to claim 1 wherein the electrode-application area is semi-spherically concave.

7. A phase-controlled, multi-electrode type of AC discharge light source according to claim 1 wherein the electrode pieces are formed by printing and sintering an electrically conductive material onto the electrode-application area.

8. A phase-controlled, multi-electrode type of AC discharge light source according to claim 1 wherein the electrode pieces are formed by plasma-spray coating an electrically conductive material onto the electrode-application area.

9. A phase-controlled, multi-electrode type of AC discharge light source according to claim 1 wherein the multi-pole magnetic field establishing means comprises a thin magnetic sheet having a strip pattern magnetized alternately with north or south pole, thereby establishing the multi-pole magnetic field on the surface of each electrode piece.

10. A phase-controlled, multi-electrode type of AC discharge light source according to claim 1 wherein the multi-pole magnetic sheet comprises a plurality of magnet strips alternately magnetized in north or south pole, the magnetic strips being laterally arranged closely to each other, thereby establishing the multi-pole magnetic field on the surface of each electrode piece.

11. A phase-controlled, ulti-electrode type of AC discharge light source according to claim 1 wherein the phase-controlled, multi-tapping ac power supply is a four-phase as power supply.

12. A phase-controlled, multi-electrode type of AC discharge light source comprising: an electric discharge tube having an electrode-application area defined on its inner wall, permitting a laser gas to flow and pass through the tube while being cooled; a layer of insulation applied to the electrode-application area; a plurality of electrode pieces arranged laterally and embedded in the layer of insulation to partly define an electric discharge chamber; cooling means outside of the so defined electric discharge chamber for cooling the electrode pieces with cooling water; multi-pole magnetic field establishing means provided in the form of a multi-poled magnet sheet having strips magnetized side by side alternately with N and S poles; and a phase-controlled, multi-tapping ac power supply connected to the electrode pieces for producing light in the electric discharge chamber.

13. A phase-controlled, multi-electrode type of AC discharge light source comprising: reflection condenser mirror means placed outside of the laser medium, the reflection condenser mirror means having a light-transparent object placed on its front side; a layer of insulation applied to the surface of the reflection condenser mirror means; a plurality of electrodes laterally arranged and embedded in the layer of insulation to delimit an electric discharge chamber; cooling means placed outside of the electric discharge chamber for cooling the electrode pieces with cooling water; multi-pole magnetic field establishing means provided in the form of a multi-poled magnet sheet having strips magnetized side by side alternately with N and S poles; and a phase-controlled, multi-tapping ac power supply connected to the electrode pieces for producing light in the electric discharge chamber.

14. A phase-controlled, multi-electrode type of AC discharge light source according to claim 13 wherein the reflection condenser mirror means is flat.

15. A phase-controlled, multi-electrode type of AC discharge light source according to claim 13 wherein the reflection condenser mirror means is concave.

16. A phase-controlled, multi-electrode type of AC discharge light source according to claim 13 wherein the reflection condenser mirror means is formed on the inner wall surface of the circular cylinder.

* * * * *